US010611167B2

(12) United States Patent
Yamagishi et al.

(10) Patent No.: US 10,611,167 B2
(45) Date of Patent: Apr. 7, 2020

(54) FLEXIBLE MEMBRANE MECHANISM, FLOW PATH MEMBER, AND LIQUID EJECTING APPARATUS

(71) Applicant: SEIKO EPSON CORPORATION, Tokyo (JP)

(72) Inventors: Ken Yamagishi, Shiojiri (JP); Hisashi Sato, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/915,617

(22) Filed: Mar. 8, 2018

(65) Prior Publication Data

US 2018/0264836 A1 Sep. 20, 2018

(30) Foreign Application Priority Data

Mar. 17, 2017 (JP) ..... 2017-053604

(51) Int. Cl.
*B41J 2/175* (2006.01)
*B41J 2/18* (2006.01)

(52) U.S. Cl.
CPC ..... *B41J 2/17596* (2013.01); *B41J 2/17513* (2013.01); *B41J 2/18* (2013.01); *B41J 2002/17516* (2013.01); *B41J 2202/12* (2013.01)

(58) Field of Classification Search
CPC ..... B41J 2/17596; B41J 2/18; B41J 2/17513; B41J 2202/12; B41J 2002/17516
See application file for complete search history.

(56) References Cited

U.S. PATENT DOCUMENTS

2008/0231671 A1* 9/2008 Lee ..... B41J 2/17509 347/85
2012/0127242 A1 5/2012 Koike et al.
2015/0273851 A1 10/2015 Akahane et al.
2017/0217199 A1* 8/2017 Yamagishi ..... B41J 2/17596

FOREIGN PATENT DOCUMENTS

JP 2012-111044 A 6/2012
JP 2014-188924 A 10/2014
JP 2015-189201 A 11/2015

* cited by examiner

*Primary Examiner* — Geoffrey S Mruk
(74) *Attorney, Agent, or Firm* — Workman Nydegger

(57) ABSTRACT

There is provided a flexible membrane mechanism that is used in a valve mechanism, the flexible membrane mechanism including: a lid member; a flexible membrane that forms a space between the lid member and the flexible membrane; and a fluid flow path that communicates with the space, in which the flexible membrane is deformed such that a valve of the valve mechanism is opened and closed and includes a protrusion portion that becomes a projection toward the lid member and becomes a recess toward the opposite side of the projection.

18 Claims, 25 Drawing Sheets

FLEXIBLE MEMBRANE MECHANISM, FLOW PATH MEMBER, AND LIQUID EJECTING APPARATUS

BACKGROUND

1. Technical Field

The present invention relates to a flexible membrane mechanism that is used for a valve mechanism and is used for opening and closing of a valve, a flow path member including the flexible membrane mechanism, and a liquid ejecting apparatus including the flexible membrane mechanism.

2. Related Art

A liquid ejecting apparatus includes a liquid ejecting head that ejects a liquid such as ink according to a pressure change of a pressure generating unit from a plurality of nozzles, as droplets, the liquid being supplied from a liquid storage unit such as an ink tank. In related art, in order to supply the liquid such as ink supplied from the liquid storage unit to the liquid ejecting head at a predetermined pressure, a configuration in which a pressure adjustment valve that is opened when a pressure of a flow path on the downstream side becomes a negative pressure in the middle of the flow path is provided, has been proposed (for example, refer to JP-A-2012-111044).

In addition, in JP-A-2012-111044, a configuration in which a flexible membrane mechanism that opens a valve by pressing the valve from the outside regardless of the pressure of the flow path on the downstream side is provided, is disclosed.

Further, a configuration in which a fluid such as air is pressurized and supplied and thus a pressure adjustment valve is pressed and opened by the pressurized fluid, is disclosed (for example, refer to JP-A-2015-189201).

However, in a case where the valve is pressed from the outside, when the entire surface of a pressure receiving portion is pressed, a reaction force which is received from the pressure receiving portion is increased. As a result, it is necessary to increase a pressure for pressing the pressure receiving portion. For this reason, as a pressure feed unit such as a pump for pressurizing the liquid to press the pressure receiving portion, a device with a high pressurizing capability or a large size is required, and this results in an increase in size and cost.

Such a problem is not limited to the flexible membrane mechanism used for a flow path member as exemplified by the liquid ejecting apparatus, and is also present in a flexible membrane mechanism used for another device including a valve mechanism.

SUMMARY

An advantage of some aspects of the invention is to provide a flexible membrane mechanism, a flow path member, and a liquid ejecting apparatus capable of pressing and operating a valve of a valve mechanism with a relatively low pressure.

According to an aspect of the invention, there is provided a flexible membrane mechanism that is used in a valve mechanism, the flexible membrane mechanism including: a lid member; a flexible membrane that forms a space between the lid member and the flexible membrane; and a fluid flow path that communicates with the space, in which the flexible membrane is deformed such that a valve of the valve mechanism is opened and closed and includes a protrusion portion that becomes a projection toward the lid member and becomes a recess toward the opposite side of the projection.

Accordingly, the flexible membrane including the protrusion portion is provided, and thus an area by which the flexible membrane receives a pressure from the fluid flow path is increased. Therefore, the flexible membrane can be operated by a relatively low pressure. In particular, the protrusion portion, which is the recess and the projection of the flexible membrane, can be deformed so as to be widened, and thus the flexible membrane can be deformed by a relatively low pressure, compared to a case where the flexible membrane is deformed and elongated by making a thickness of the flexible membrane thin.

In the flexible membrane mechanism, preferably, the flexible membrane includes a fixed portion that is fixed outside the space and a flexible portion that is extended from the fixed portion into the space, and a length of the flexible portion from a root of the flexible portion toward the fixed portion to a contact position between the flexible portion and the valve mechanism is longer than the shortest distance between the root of the flexible portion of the flexible membrane and the valve. Accordingly, when the protrusion portion of the flexible membrane is deformed so as to be widened, the flexible membrane can be reliably brought into contact with the valve, and thus the valve can be reliably operated by the flexible membrane. In addition, the flexible membrane does not need to be deformed so as to be elongated, and thus the flexible membrane can be operated at a relatively low pressure.

In addition, preferably, the flexible membrane is interposed and fixed between the lid member and a member provided on the lid member toward the flexible membrane, and opposing inner wall surfaces of the recess of the flexible membrane are disposed with a distance therebetween without being in contact with each other. Accordingly, a hindrance of the deformation of the flexible membrane can be prevented, and thus the flexible membrane can be operated at a relatively low pressure.

In addition, preferably, the flexible membrane includes a fixed portion that is disposed outside the space and is interposed and fixed between the lid member and a member provided on the lid member toward the flexible membrane, and a flexible portion that is extended from the fixed portion into the space, and, in a direction in which the fixed portion of the flexible membrane is interposed, the center of an end portion of the flexible portion toward the fixed portion is positioned at a position closer to the valve than the center of an end portion of the fixed portion toward the flexible portion is. Accordingly, the flexible membrane can be prevented from being deformed so as to protrude toward the lid member, and thus it is possible to prevent an increase in distance between the flexible membrane and the valve.

In addition, preferably, the valve mechanism includes a chamber which communicates with the valve and a film which defines at least a part of the chamber and is deformed such that the valve is opened or closed by deformation of the film, and the flexible membrane mechanism further includes a spacer for maintaining a constant distance between the film and the flexible membrane. Accordingly, a constant distance is maintained between the film and the flexible membrane by the spacer. Thus, in a state where the flexible membrane is not operated, a hindrance of the deformation of the film by the flexible membrane can be prevented.

According to another aspect of the invention, there is provided a flow path member including: the flexible membrane mechanism according to the aspect; and a valve mechanism.

Accordingly, it is possible to realize a flow path member capable of pressing and operating the valve of the valve mechanism with a relatively low pressure.

According to still another aspect of the invention, there is provided a liquid ejecting apparatus including: the flexible membrane mechanism according to the aspect; and a liquid ejecting head that ejects a liquid.

Accordingly, it is possible to realize a liquid ejecting apparatus capable of pressing and operating the valve of the valve mechanism with a relatively low pressure.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
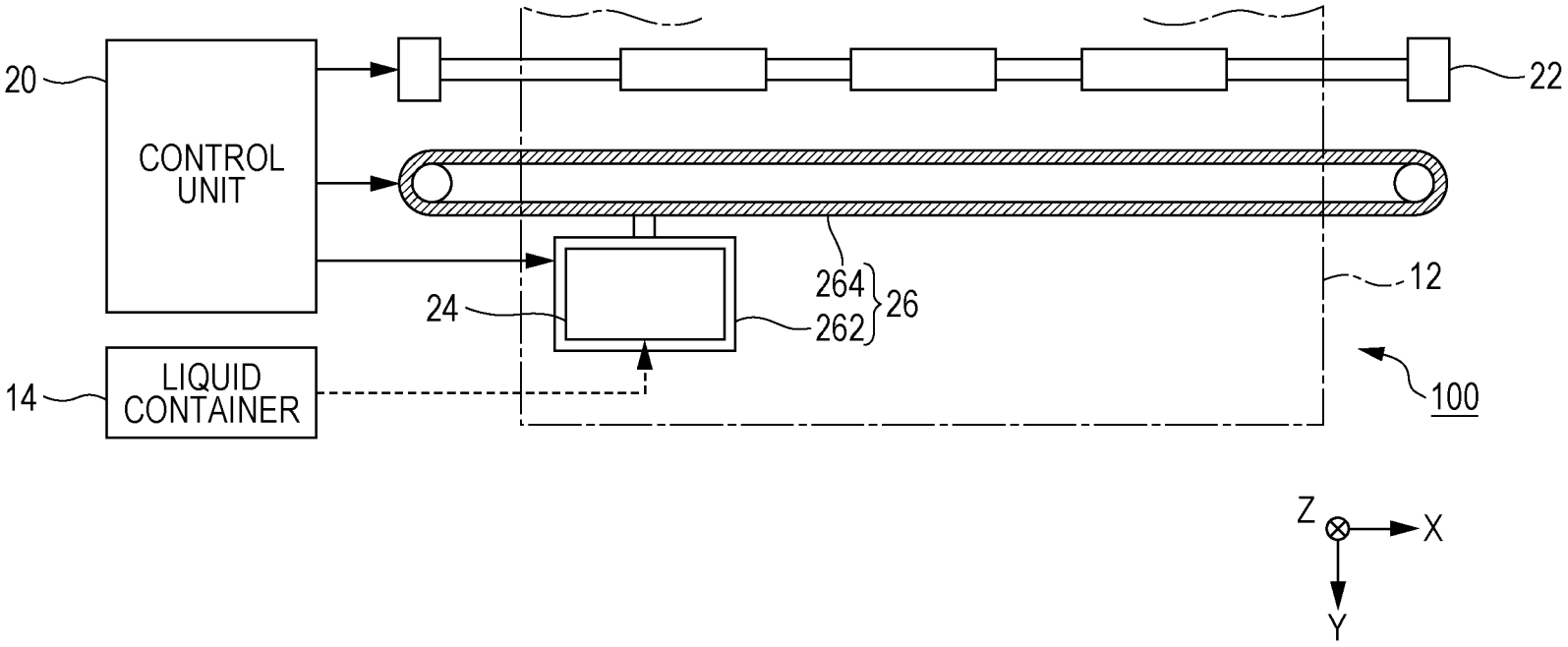
FIG. 1 is a diagram illustrating a configuration of a liquid ejecting apparatus according to a first embodiment of the invention.

FIG. 1 is a diagram illustrating a configuration of a liquid ejecting apparatus according to a first embodiment of the invention. The liquid ejecting apparatus 100 according to the present embodiment is an ink jet type recording apparatus that ejects ink as a liquid onto a medium 12. Examples of the medium 12 include, for example, paper, a resin film, a cloth, and the like.

A liquid container 14 that stores the ink is fixed to the liquid ejecting apparatus 100. As the liquid container 14, for example, a cartridge that can be detachably attached to the liquid ejecting apparatus 100, a bag-shaped ink pack that is formed by a flexible film, an ink tank that can supplement ink, or the like is used. Although not specifically illustrated, a plurality of kinds of ink with different colors and different types are stored in the liquid container 14.

In addition, the liquid ejecting apparatus 100 includes a control unit 20 as a controller, a transport mechanism 22, and a liquid ejecting head 24.

Although not specifically illustrated, the control unit 20 is configured to include, for example, a control device such as a central processing unit (CPU) or a field programmable gate array (FPGA) and a memory device such as a semiconductor memory, and overall controls each element of the liquid ejecting apparatus 100 by executing a program stored in the memory device by the control device.

The transport mechanism 22 is controlled by the control unit 20 so as to transport the medium 12 in a Y direction, and includes, for example, a transport roller. The transport mechanism for transporting the medium 12 is not limited to the transport roller, and may transport the medium 12 by a belt or a drum.

A movement mechanism 26 is controlled by the control unit 20 so as to reciprocate the liquid ejecting head 24 in an X direction. The X direction in which the liquid ejecting head 24 is reciprocated by the movement mechanism 26 is a direction intersecting with the Y direction in which the medium 12 is transported. In addition, in the present embodiment, a direction intersecting with both of the X direction and the Y direction is referred to as a Z direction. In the present embodiment, although the respective directions (X, Y, and Z directions) are in an orthogonal relationship, an arrangement relationship of the respective components is not necessarily limited to the orthogonal relationship.

Specifically, the movement mechanism 26 according to the present embodiment includes a transport body 262 and a transport belt 264. The transport body 262 is a substantially box-shaped structure, so-called a carriage, that supports the liquid ejecting head 24, and is fixed to the transport belt 264. The transport belt 264 is an endless belt that is placed along the X direction. The transport belt 264 is rotated under the control of the control unit 20, and thus the liquid ejecting head 24 is reciprocated along the X-direction together with the transport body 262. The liquid container 14 may be mounted to the transport body 262 together with the liquid ejecting head 24.

The liquid ejecting head 24 ejects the ink supplied from the liquid container 14 onto the medium 12, as droplets, under the control of the control unit 20. The ejection of the ink droplets from the liquid ejecting head 24 is performed toward the positive Z direction. When the medium 12 is transported in the Y direction by the transport mechanism 22 and the liquid ejecting head 24 is transported in the X direction by the movement mechanism 26, the liquid ejecting head 24 ejects the ink droplets onto the medium 12, and thus a desired image is formed on the medium 12.

Figure 2:
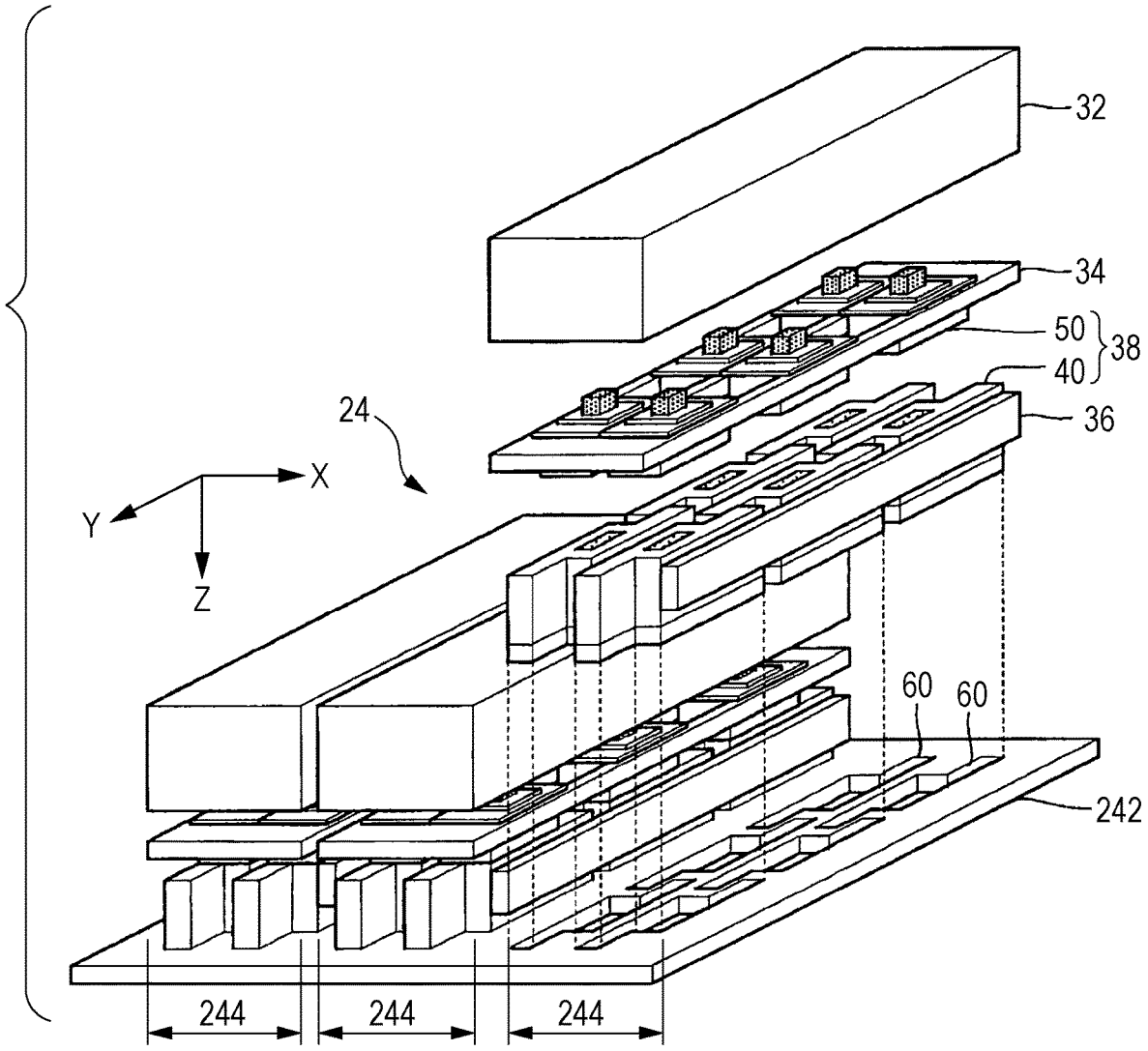
FIG. 2 is an exploded perspective view of a liquid ejecting head.

Hereinafter, the liquid ejecting head 24 according to the present embodiment will be described in detail with reference to FIG. 2. FIG. 2 is an exploded perspective view of the liquid ejecting head according to the first embodiment of the invention.

As illustrated in FIG. 2, the liquid ejecting head 24 according to the present embodiment includes a first support body 242 and a plurality of assemblies 244. The first support body 242 is a plate-shaped member that supports the plurality of assemblies 244. The plurality of assemblies 244 are fixed to the first support body 242 in a state of being disposed side by side in the X direction.

Each of the plurality of assemblies 244 includes a connection unit 32, a second support body 34, a distribution flow path 36, a plurality of liquid ejecting modules (in the present embodiment, six liquid ejecting modules) 38. The number of the assemblies 244 that constitute the liquid ejecting head 24 and the number of the liquid ejecting modules 38 that constitute the assembly 244 are not limited to the numbers described above.

The plurality of liquid ejecting modules 38 are disposed side by side in the Y direction and in two rows in the X direction at the second support body 34 that is positioned at a position in the positive Z direction of the connection unit 32. The distribution flow path 36 is disposed at sides of the plurality of liquid ejecting modules 38 in the X direction. The distribution flow path 36 is a structure in which a flow path for distributing the ink supplied from the liquid container 14 to each of the plurality of liquid ejecting modules 38 is formed. The distribution flow path 36 is configured to be elongated in the Y-direction across the plurality of liquid ejecting modules 38.

The liquid ejecting module 38 includes a liquid ejecting unit 40 and a coupling unit 50. The liquid ejecting unit 40 ejects the ink onto the medium 12, as the ink droplets, the ink being supplied from the liquid container 14 via the distribution flow path 36.

Figure 3:
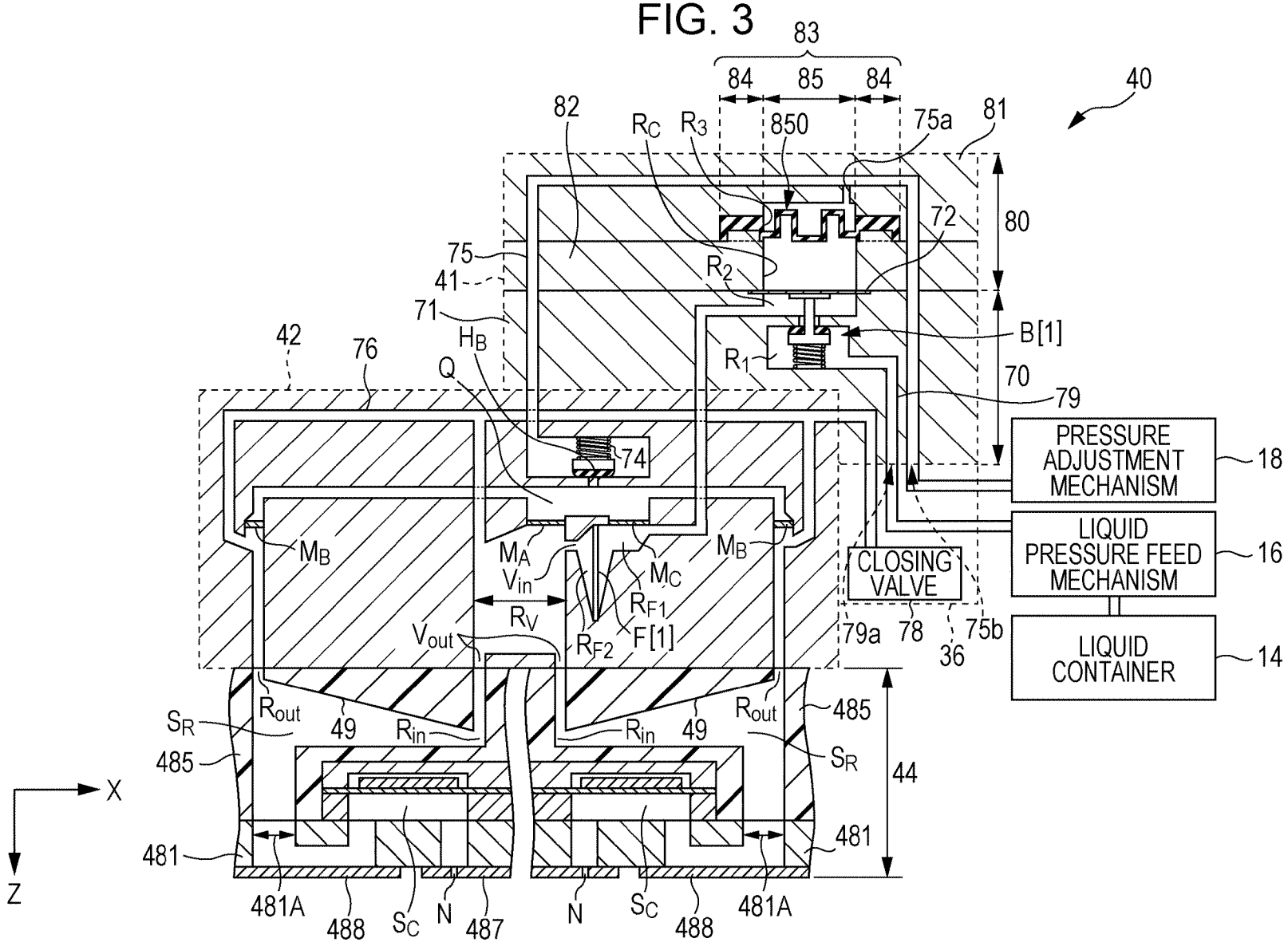
FIG. 3 is a diagram explaining an internal flow path of a liquid ejecting unit.

The liquid ejecting unit 40 according to the present embodiment will be described with reference to FIG. 3. FIG. 3 is a sectional view illustrating a flow path unit according to the present embodiment.

As illustrated in FIG. 3, the liquid ejecting unit 40 according to the present embodiment includes a flow path unit 41 as a flow path member, a degassing flow path unit 42, and a liquid ejecting portion 44.

Figure 4:
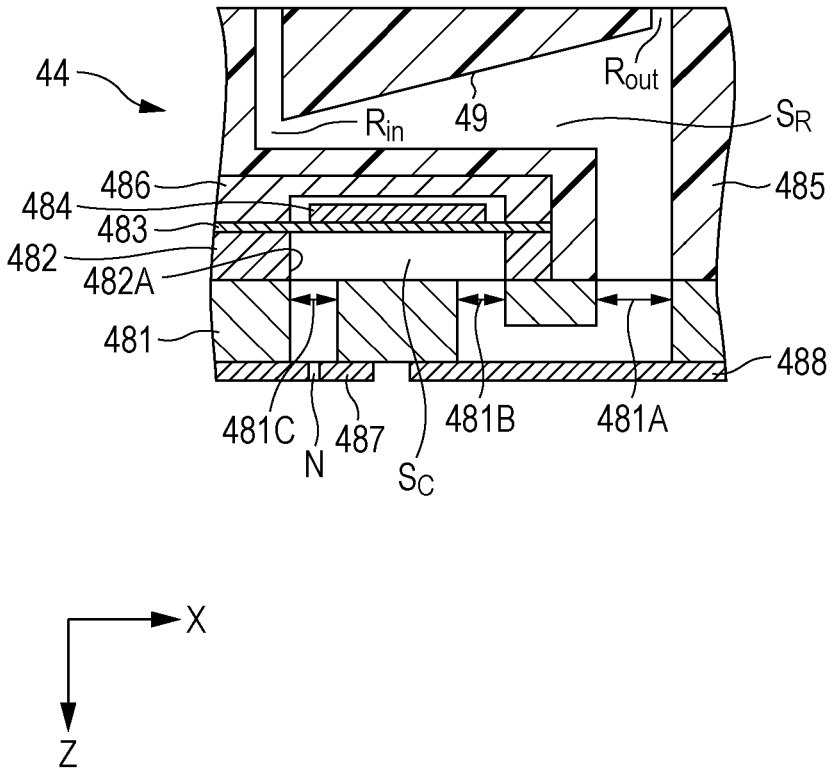
FIG. 4 is a sectional view of a liquid ejecting portion.

Hereinafter, the liquid ejecting portion 44 will be described with reference to FIG. 4. FIG. 4 is a sectional view of a portion corresponding to any one nozzle N of the liquid ejecting head.

As illustrated in FIG. 3, the liquid ejecting portion 44 according to the present embodiment is a structure in which a pressure chamber substrate 482, a vibration plate 483, a piezoelectric actuator 484, a housing portion 485, and a protection substrate 486 are disposed on one side of a flow path substrate 481, and in which a nozzle plate 487 and a buffer plate 488 are disposed on the other side of the flow path substrate 481.

The flow path substrate 481, the pressure chamber substrate 482, and the nozzle plate 487 are formed with, for example, a flat plate member of silicon, and the housing portion 485 is formed, for example, by injection molding of a resin material. The plurality of nozzles N are formed in the nozzle plate 487. A front surface of the nozzle plate 487 that is opposite to the flow path substrate 481 is an ejection surface.

In the flow path substrate 481, an opening portion 481A, a branch flow path 481B as a throttle flow path, and a communication flow path 481C are formed. The branch flow path 481B and the communication flow path 481C are through-holes that are formed for each of the nozzles N, and the opening portion 481A is an opening that is continuously formed across the plurality of nozzles N. The buffer plate 488 is a compliance substrate made of a flat plate member that is provided on a front surface of the flow path substrate 481 opposite to the pressure chamber substrate 482 and closes the opening portion 481A. The buffer plate 488 is flexibly deformed, and thus a pressure change in the opening portion 481A is absorbed by the deformation of the buffer plate 488.

In the housing portion 485, a manifold $S_R$ as a common liquid chamber that communicates with the opening portion 481A of the flow path substrate 481 is formed. The manifold $S_R$ is a space for storing the ink supplied to the plurality of nozzles N, and is continuously provided across the plurality of nozzles N. In addition, an inflow port $R_{in}$ into which the ink supplied from the upstream side flows is formed in the manifold $S_R$.

An opening portion 482A is formed in the pressure chamber substrate 482 for each of the nozzles N. The vibration plate 483 is a flat plate member which is elastically deformable and is provided on a front surface of the pressure chamber substrate 482 that is opposite to the flow path substrate 481. A space that is interposed between the vibration plate 483 and the flow path substrate 481 at the inside of the opening portion 482A of the pressure chamber substrate 482 functions as a pressure chamber $S_C$ (cavity) in which the ink supplied from the manifold $S_R$ via the branch flow path 481B is filled. Each pressure chamber $S_C$ communicates with the nozzle N via the communication flow path 481C of the flow path substrate 481.

The piezoelectric actuator 484 is formed on a front surface of the vibration plate 483 that is opposite to the pressure chamber substrate 482 for each of the nozzles N. Each piezoelectric actuator 484 is a driving element in which a piezoelectric body is interposed between electrodes opposite to each other. The piezoelectric actuator 484 is deformed based on a driving signal, and thus the vibration plate 483 is vibrated. Therefore, a pressure of the ink in the pressure chamber $S_C$ is changed, and thus the ink in the pressure chamber $S_C$ is ejected from the nozzle N. In addition, the protection substrate 486 protects a plurality of piezoelectric actuators 484.

Figure 5:
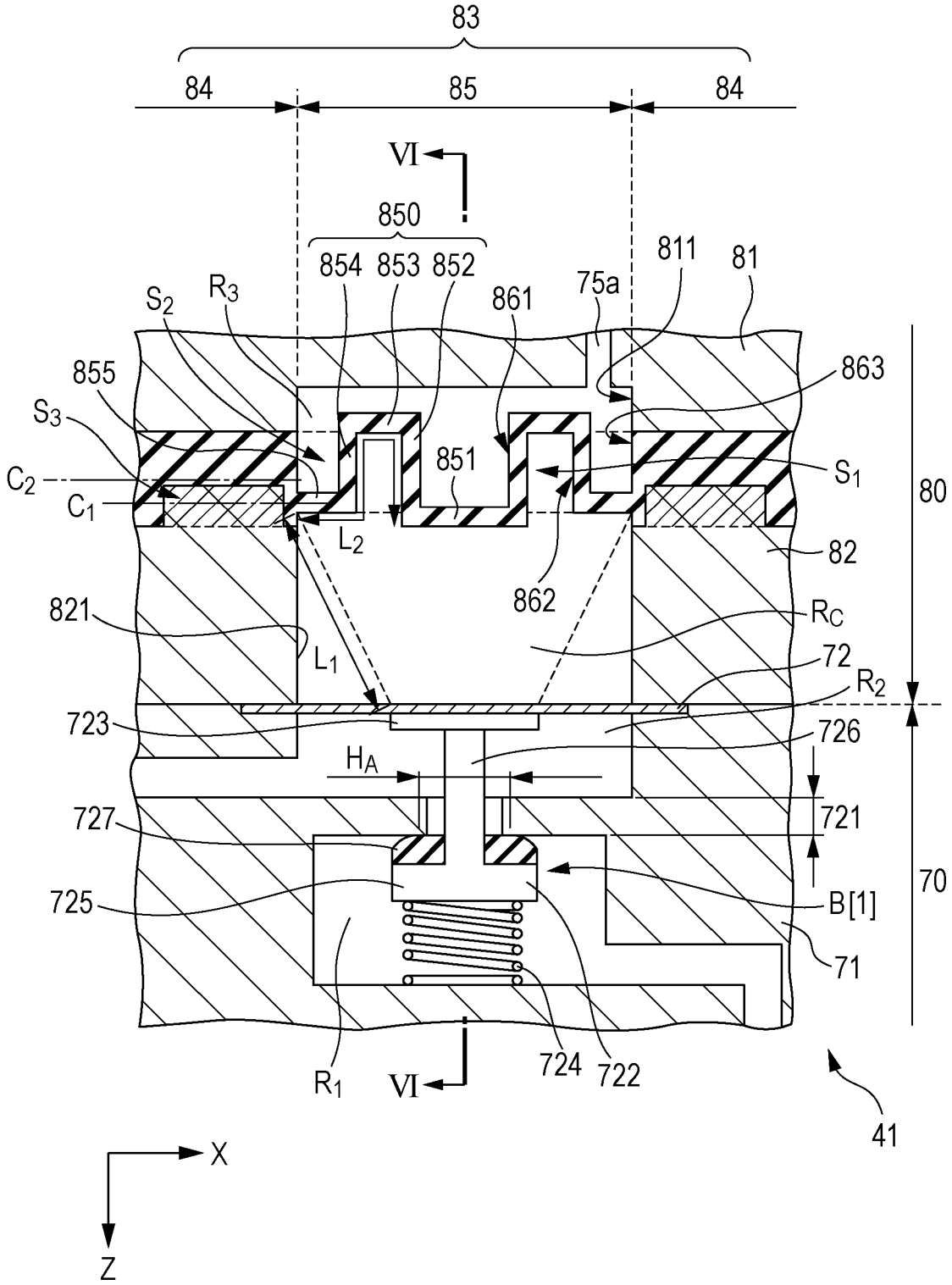
FIG. 5 is a sectional view of a main portion of a flow path unit.
Figure 6:
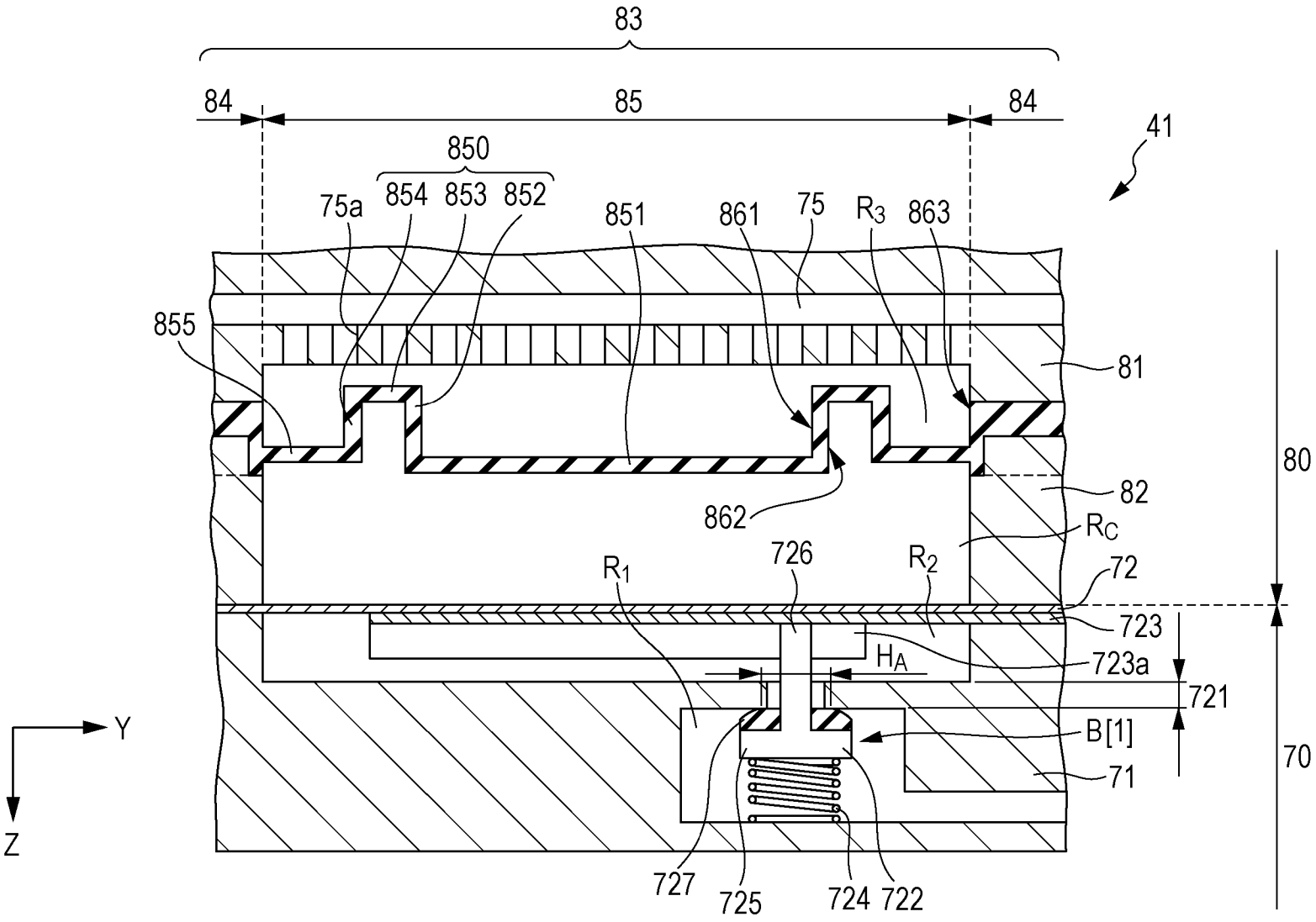
FIG. 6 is a sectional view of a main portion of the flow path unit.
Figure 7:
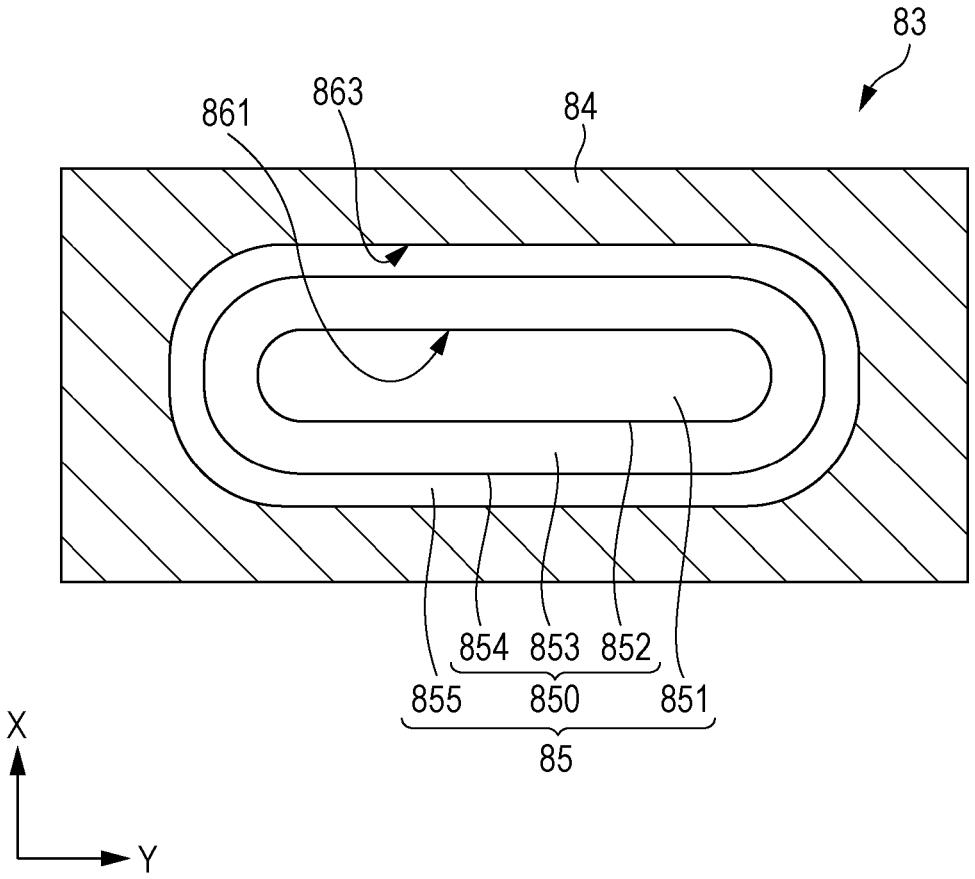
FIG. 7 is a plan view of a flexible membrane.
Figure 8:
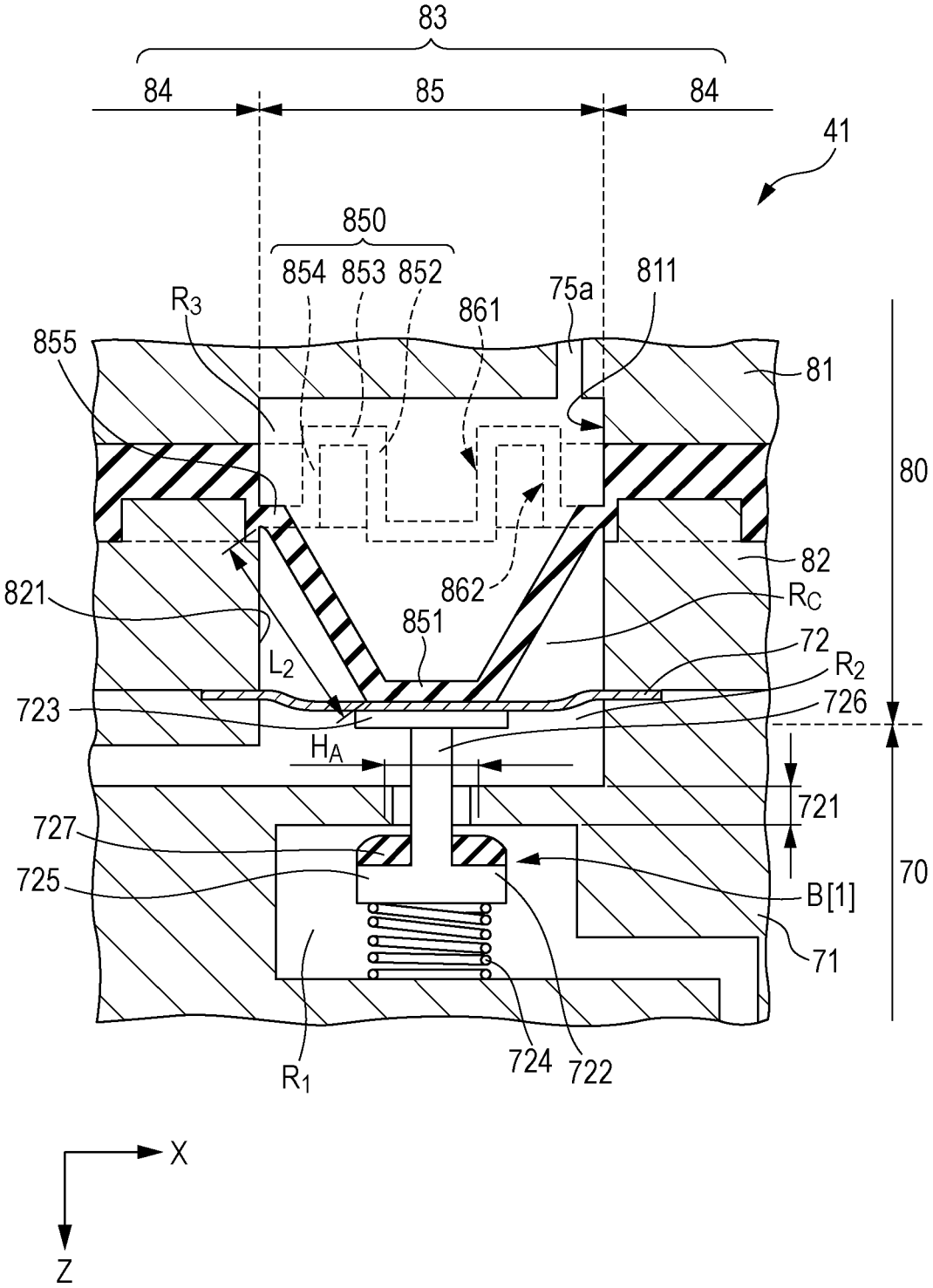
FIG. 8 is a sectional view of a main portion of the flow path unit.

Hereinafter, the flow path unit 41 of the liquid ejecting unit 40 will be described with reference to FIGS. 5 and 8. FIG. 5 is a sectional view of a main portion of the flow path unit of FIG. 3 in a depressurization operation, and FIG. 6 is a sectional view taken along a line VI-VI of FIG. 5. FIG. 7 is a plan view of a flexible membrane, and FIG. 8 is a sectional view of a main portion of the flow path unit in a pressurization operation.

As illustrated in FIGS. 3 and 5, the flow path unit 41 includes a valve mechanism 70 and a flexible membrane mechanism 80. A space $R_1$, a space $R_2$, a control chamber $R_C$, and a space $R_3$ are formed inside the flow path unit 41. In the present embodiment, the space $R_1$ and the space $R_2$ are formed in the valve mechanism 70, the space $R_3$ is formed in the flexible membrane mechanism 80, the control chamber $R_C$ is formed between the valve mechanism 70 and the flexible membrane mechanism 80.

The valve mechanism 70 includes a valve mechanism housing 71, an opening/closing valve B[1], and a film 72. The space $R_1$ connected to a liquid pressure feed mechanism 16 is provided in the valve mechanism housing 71. The liquid pressure feed mechanism 16 is a mechanism that supplies, that is, pressure-feeds the ink stored in the liquid container 14 to the liquid ejecting unit 40 in a pressurized state. In addition, the space $R_2$ connected to the degassing flow path unit 42 is provided in the valve mechanism housing 71. A film 72 as a movable film is provided on the valve mechanism housing 71 toward the flexible membrane mechanism 80, that is, in the negative Z direction, and a part of a wall surface of the space $R_2$ is configured with the film 72. In addition, the opening/closing valve B[1] is provided between the space $R_1$ and the space $R_2$.

The opening/closing valve B[1] includes a valve seat 721, a valve body 722, a pressure receiving plate 723, and a spring 724. The valve seat 721 is a part of the valve mechanism housing 71, and is a flat plate-shaped portion that partitions the space $R_1$ and the space $R_2$. In the valve seat 721, a communication hole $H_A$ through which the space $R_1$ and the space $R_2$ communicate with each other is formed. The pressure receiving plate 723 is a substantially circular-shaped flat plate member which is provided on a surface of the film 72 that faces the valve seat 721. That is, the pressure receiving plate 723 is provided on the film 72. In this way, the pressure receiving plate 723 is provided on the film 72, and thus it is possible to prevent a damage and a deformation of the film 72, compared to a case where the valve body 722 is brought into direct contact with the film 72. The pressure receiving plate 723 may be bonded to the film 72, or may not be bonded to the film 72. In other words, a state where the pressure receiving plate 723 is provided on the film 72 includes a state where the pressure receiving plate 723 is bonded to the film 72, and a state where the pressure receiving plate 723 is disposed so as to be brought into contact with the film 72 without being bonded to the film 72. In a case where the pressure receiving plate 723 is bonded to the film 72, a pressure that a flexible membrane 83 to be described in detail receives from the ink via the film 72 depends on an area of the pressure receiving plate 723. In a case where the pressure receiving plate 723 is not bonded to the film 72, a pressure that a front end of the flexible membrane 83 receives from the ink via the film 72 depends on an area of the front end of the flexible membrane 83. In the present embodiment, the pressure receiving plate 723 is not bonded to the film 72.

The valve body 722 includes a base portion 725, a valve shaft 726, and a sealing portion 727. The valve shaft 726 projects vertically from a front surface of the base portion 725, and the ring-shaped sealing portion 727 that surrounds the valve shaft 726 in plan view is provided on the front surface of the base portion 725. The valve body 722 is disposed in the space $R_1$ in a state where the valve shaft 726 is inserted into the communication hole $H_A$, and is energized toward the valve seat 721, that is, toward the negative Z direction, by the spring 724. A gap is formed between an outer peripheral surface of the valve shaft 726 and an inner peripheral surface of the communication hole $H_A$.

The flexible membrane mechanism 80 includes a lid member 81, a spacer 82, and a flexible membrane 83. A recess portion 811 which is opened toward the valve mechanism 70, that is, in the positive Z direction, is provided in the lid member 81, an opening of the recess portion 811 is covered by the flexible membrane 83, and thus the space $R_3$ is formed in the lid member 81. In addition, the spacer 82 is provided on the lid member 81 toward the film 72. That is, the spacer 82 is provided between the film 72 of the valve mechanism 70 and the lid member 81. A penetration portion 821 which penetrates the spacer 82 in the Z direction is provided in the spacer 82 at a position overlapping with the space $R_3$ in the Z-direction, and the control chamber $R_C$ is formed inside the penetration portion 821. That is, the flexible membrane 83 is interposed between the control chamber $R_C$ and the space $R_3$. In addition, a part of a wall surface of the control chamber $R_C$ is configured with the film 72 and the flexible membrane 83. The space $R_3$ is connected to a degassing path 75 as a fluid flow path, which is connected to a pressure adjustment mechanism 18 as a fluid supply source. In the present embodiment, the degassing path 75 is connected to an opening portion 75*a* which is opened to a wall of the space $R_3$ that faces the flexible membrane 83 in the Z-direction.

The flexible membrane 83 is formed of an elastic material such as rubber or elastomer. In the present embodiment, when the space $R_3$ is pressurized by a pressurization operation of the pressure adjustment mechanism 18 via the degassing path 75, the flexible membrane 83 is elastically deformed so as to protrude in a projection shape toward the inside of the control chamber $R_C$, that is, toward the film 72.

As illustrated in FIGS. 5, 6, and 7, the flexible membrane 83 is configured with fixed portions 84 and a flexible portion 85 extending from the fixed portions 84 into the space $R_3$, the fixed portion 84 being interposed between the lid member 81 and a member provided on a surface of the lid member 81 to which the recess portion 811 is opened, in the present embodiment, the spacer 82. Thus, the fixed portion 84 is fixed outside the space $R_3$. In addition, the flexible portion 85 includes a protrusion portion 850 including a projection which is projected toward the space $R_3$ and a recess which is recessed toward the film 72 and is opposite to the projection in a case where the pressurization operation is not performed.

In the present embodiment, the flexible portion 85 includes a contact portion 851, a first wall portion 852, a first connection portion 853, a second wall portion 854, and a second connection portion 855. The contact portion 851, the first wall portion 852, the first connection portion 853, the second wall portion 854, and the second connection portion 855 that constitute the flexible portion 85 have substantially the same thickness, and the fixed portion 84 is thicker than the flexible portion 85.

In the present embodiment, the contact portion 851 is a portion that contacts with the opening/closing valve B[1] when the flexible membrane 83 is elastically deformed, and is provided at a position facing the pressure receiving plate 723 in the Z direction, that is, at a position overlapping with the pressure receiving plate 723 when viewed from the Z direction in plan view. In the present embodiment, the center of the pressure receiving plate 723 is positioned at the center of the control chamber $R_C$ when viewed from the Z direction in plan view, and thus the contact portion 851 is disposed at a position corresponding to the center of the control chamber $R_C$. In the present embodiment, the contact portion 851 extends along the X direction and the Y direction. In addition, the contact portion 851 has an area smaller than the area of the pressure receiving plate 723. The fact that the contact portion 851 has an area smaller than the area of the pressure receiving plate means that the contact portion 851 has a width narrower than the width of the pressure receiving plate 723 in both directions of the X direction and the Y direction. In this way, the contact portion 851 has an area smaller than the area of the pressure receiving plate 723, and thus, even in a case where the position of the contact portion 851 is displaced, it is possible to reliably press the pressure receiving plate 723 by the contact portion 851.

The first wall portion 852 is provided in a continuous annular shape around the contact portion 851. The first wall portion 852 is erectly provided on the opposite side of the film 72 to be closer to the lid member 81 than the contact portion 851 is. Specifically, one end of the first wall portion 852 is connected to the contact portion 851, and the other end of the first wall portion 852 is extended along the Z direction so as to be positioned at a position opposite to the film 72 and closer to the lid member 81 than the contact portion 851 is.

The first connection portion 853 is provided in a continuous annular shape around the first wall portion 852. One end of the first connection portion 853 is connected to the other end of the first wall portion 852 that is positioned toward the lid member 81, and the other end of the first connection portion 853 is extended along the X direction and the Y direction so as to be positioned outside the first wall portion 852.

The second wall portion 854 is provided in a continuous annular shape around the first connection portion 853. The second wall portion 854 is erectly provided to be closer to the film 72 than the first connection portion 853 is. Specifically, one end of the second wall portion 854 is connected to the first connection portion 853, and the other end of the second wall portion 854 is extended along the Z direction so as to be positioned at a position closer to the film 72 than the first connection portion 853 is and closer to the lid member 81 than the contact portion 851 is.

The second connection portion 855 is provided in a continuous annular shape around the second wall portion 854. One end of the second connection portion 855 is connected to the other end of the second wall portion 854, and the other end of the second connection portion 855 is extended along the X direction as a first direction and the Y direction as a second direction so as to be positioned outside the second wall portion 854. In addition, the other end of the second connection portion 855, which is opposite to one end of the second connection portion 855 connected to the second wall portion 854, is connected to the fixed portion 84. That is, the second connection portion 855 connects the fixed portion 84 and the second wall portion 854. In the flexible membrane 83, in the Z direction in which the fixed portion 84 is interposed between the lid member 81 and the spacer 82, a root of the flexible portion 85 toward the fixed portion 84, that is, the center $C_1$ of the end portion of the second connection portion 855 toward the fixed portion 84, is provided at a position closer to the opening/closing valve B[1] than the center $C_2$ of the end portion of the fixed portion 84 toward the flexible portion 85 is.

In this manner, a bellows is formed around the contact portion 851 by the first wall portion 852, the first connection portion 853, the second wall portion 854, and the second connection portion 855, which have the same center and have an annular shape. That is, on the flexible portion 85 according to the present embodiment, a first recess portion 861 which is opened toward the lid member 81 is provided by the contact portion 851 and the first wall portion 852 provided around the contact portion 851. In addition, around the first recess portion 861, a second recess portion 862, which is opened toward the film 72 by the first wall portion 852, the first connection portion 853, and the second wall portion 854, is provided in a continuous annular shape in a circumferential direction thereof. Further, around the second recess portion 862, a third recess portion 863, which is opened toward the lid member 81 by the second wall portion 854, the second connection portion 855, and the fixed portion 84, is provided in a continuous annular shape in a circumferential direction thereof. The first recess portion 861, the second recess portion 862, and the third recess portion 863 are provided at positions not overlapping with each other when viewed from the Z direction in plan view, and a bellows is formed by the recess portions. That is, in the present embodiment, the first wall portion 852, the first connection portion 853, and the second wall portion 854 of the flexible portion 85 form the protrusion portion 850, which becomes the projection toward the lid member 81 and becomes the recess toward the film 72 (the second recess portion 862). In addition, when the projection is not formed toward the lid member 81 and the recess is not formed toward the film 72, it cannot be said that the protrusion portion of the flexible membrane is formed. In other words, even when the projection of the flexible membrane is formed toward the lid member 81 by changing a thickness of a part of the plate-shaped flexible membrane, in a case where a flat surface is formed toward the film 72, it cannot be said that the protrusion portion is formed. Similarly, in a case where a groove as the recess is formed toward the film 72 of the flexible membrane and a flat surface is formed toward the lid member 81, it cannot be said that the protrusion portion is formed.

In addition, in the present embodiment, opposing inner wall surfaces of the second recess portion 862 are disposed with a distance therebetween without being in contact with each other, the second recess portion 862 being recessed toward the film 72 by the protrusion portion 850. That is, the first wall portion 852 and the second wall portion 854 are disposed with a predetermined distance therebetween without being in contact with each other. In the present embodiment, similar to the second recess portion 862, opposing inner wall surfaces of each of the first recess portion 861 and the third recess portion 863 are disposed with a predetermined distance therebetween without being in contact with each other.

As illustrated in FIG. 3, the degassing path 75 connected to the space $R_3$ is connected to the pressure adjustment mechanism 18 as a fluid supply source via a flow path in the distribution flow path 36. The pressure adjustment mechanism 18 can selectively execute a pressurization operation for supplying air as fluid to the flow path connected to the pressure adjustment mechanism 18, and a depressurization operation for sucking air as fluid from the flow path, according to an instruction from the control unit 20. The flexible membrane 83 is deformed so as to protrude toward the film 72 by supplying air from the pressure adjustment mechanism 18 to the internal space (that is, pressurizing). The deformation of the flexible membrane 83 is released by sucking air using the pressure adjustment mechanism 18 (that is, depressurizing), and thus the flexible membrane 83 returns to an original state.

Here, when the flexible membrane 83 is deformed by the pressurization operation of the pressure adjustment mechanism 18, as illustrated in FIG. 8, the contact portion 851 is elastically deformed so as to move toward the film 72. That is, the flexible portion 85 is elastically deformed such that the first wall portion 852, the first connection portion 853, and the second wall portion 854 forming the bellows are expanded, and thus the contact portion 851 moves toward the opening/closing valve B[1]. The fact that the second recess portion 862 formed by the first wall portion 852, the first connection portion 853, and the second wall portion 854 is elastically deformed so as to be expanded means that the second wall portion 854 extending from the second connection portion 855 in the negative Z direction is elastically deformed so as to be bent in the positive Z direction. In the present embodiment, as the flexible portion 85 is elastically deformed, the first wall portion 852, the first connection portion 853, the second wall portion 854, and the second connection portion 855 are disposed toward a boundary between the fixed portion 84 and the flexible portion 85, that is, on a substantially straight line from the root of the flexible portion 85 to the film 72, and thus the contact portion 851 is moved toward the film 72. The contact portion 851 that is moved toward the film 72 is brought into contact with the film 72, and presses the film 72 in the positive Z direction. Thus, the opening/closing valve B[1] is opened.

That is, in the present embodiment, since only the contact portion 851 of the flexible portion 85 is brought into contact with the film 72 so as to open the opening/closing valve B[1], an area of a front end of the flexible portion 85 that presses the film 72 is smaller than an area of a rear end of the flexible portion 85 that receives the supply pressure. In this manner, the area of the rear end surface of the flexible portion 85 that receives the supply pressure and is positioned toward the degassing path 75 is increased. Thus, it possible to easily receive the pressure from the pressure adjustment mechanism 18 by the relatively large area. Further, by reducing the area of the contact portion 851 of the flexible portion 85 that is brought into contact with the film 72, it possible to reduce repulsion according to the pressure of the ink in the space $R_2$ that presses the film 72. For example, in a case where a ratio of the area of the contact portion 851 of the flexible portion 85 that is brought into contact with the film 72 to the area of the rear end surface of the flexible portion 85 is 1:5, when it is assumed that a pressure of the air by the pressure adjustment mechanism 18 is Pa (Pa), that a pressure of the ink is Pi (Pa), that a spring force is Fs (N), that a reaction force of the film 72 is F (N), that a pressure receiving area of the rear end surface of the flexible portion 85 is A ($m^2$), that a pressure receiving area of the contact portion 851 of the flexible portion 85 that receives the pressure from the film 72 is Af ($m^2$) (=⅕·A), and that a rubber reaction force of the flexible portion 85 is Fg (N), a required condition for opening the opening/closing valve B[1] is represented by $Pa \cdot A - Fg > Pi(\frac{1}{5} \cdot A) + Fs + F$, that is, $Pa > (\frac{1}{5})Pi + (Fs+F+Fg)/A$. As represented by this expression, in a case where the contact portion 851 according to the present embodiment is provided, the pressure Pa of the pressure adjustment mechanism 18 that is required for opening the opening/closing valve B[1] can be set to reduce an influence on the pressure Pi of the ink in the space $R_2$ partitioned by the film 72 to ⅕. Therefore, a repulsion force of the contact portion 851 by the film 72 decreases, and thus, even when the pressure of the degassing path 75 by the pressure adjustment mechanism 18 is low, the deformation of the flexible portion 85 can be maintained. As a result, it is unnecessary that the pressure adjustment mechanism 18 supplies a high pressure to the degassing path 75, and a time until the pressure adjustment mechanism 18 pressurizes the degassing path 75 at a high pressure is unnecessary. Therefore, it is possible to shorten a time required for the pressurization operation and improve durability of the pressure adjustment mechanism 18. In addition, as the pressure adjustment mechanism 18, a device capable of outputting a high pressure is unnecessary, and thus it is possible to reduce a size and a cost of the pressure adjustment mechanism 18. Further, the pressure of the pressure adjustment mechanism 18 that is required for opening the opening/closing valve B[1] has little influence on a change in the pressure of the ink in the space $R_2$, and thus it is possible to simplify a design of the pressure adjustment mechanism 18.

As illustrated in FIG. 5, in the flexible membrane 83, a length from the root of the flexible portion 85 toward the fixed portion 84 to a contact position between the flexible portion 85 and the opening/closing valve B[1], is longer than the shortest distance between the root of the flexible portion 85 of the flexible membrane 83 and the opening/closing valve B[1]. Here, in the present embodiment, the flexible membrane 83 is brought into contact with the opening/closing valve B[1], more specifically, the contact portion 851 of the flexible portion 85 is brought into contact with a region of the film 72 at which the pressure receiving plate 723 is provided. Thus, the shortest distance between the root of the flexible portion 85 and the opening/closing valve B[1] means the shortest distance $L_1$ connecting the root of the flexible portion 85 and the region of the film 72 that contacts with the contact portion 851. In addition, a length from the root of the flexible portion 85 toward the fixed portion 84 to the contact position between the flexible portion 85 and the opening/closing valve B[1] means a total length $L_2$ of the second connection portion 855, the second wall portion 854, the first connection portion 853, and the first wall portion 852. The total length $L_2$ of the second connection portion 855, the second wall portion 854, the first connection portion 853, and the first wall portion 852 of the flexible membrane 83 is longer than the shortest distance $L_1$ connecting the root of the flexible portion 85 of the flexible membrane 83 and the region of the film 72 that contacts with the contact portion 851 ($L_2 > L_1$). In this manner, by making the length $L_2$ from the root of the flexible portion 85 of the flexible membrane 83 to the contact portion 851 longer than the shortest distance $L_1$ from the root of the flexible membrane 83 to the opening/closing valve B[1], as illustrated in FIG. 8, when the flexible membrane 83 is deformed so as to protrude toward the opening/closing valve B[1] by the pressurization operation, the contact portion 851 reliably presses the opening/closing valve B[1], and thus the opening/closing valve B[1] can be opened. When the length $L_2$ from the root of the flexible portion 85 of the flexible membrane 83 to the contact portion 851 is shorter than the shortest distance $L_1$ from the root of the flexible membrane 83 to the opening/closing valve B[1], it is difficult to bring the contact portion 851 into contact with the opening/closing valve B[1] by the operation pressurization. In addition, in order to bring the contact portion 851 into contact with the opening/closing valve B[1], it is necessary to deform the bellows to be opened, move the contact portion 851 toward the opening/closing valve B[1], and then elongate the flexible portion 85 by elastic deformation by making a thickness of the flexible portion 85 thin. In order to elastically deform the flexible portion 85 so as to be elongated as described above, it is necessary to increase the pressure in the pressurization operation. In this regard, by making the length $L_2$ from the root of the flexible portion 85 of the flexible membrane 83 to the contact portion 851 longer than the shortest distance $L_1$ from the root of the flexible membrane 83 to the opening/closing valve B[1], the opening/closing valve B[1] can be reliably pressed by the contact portion 851, and thus it is possible to decrease the pressure in the pressurization operation to a relatively low pressure.

In addition, in the present embodiment, as illustrated in FIG. 5, when the depressurization operation is performed, opposing inner wall surfaces of the second recess portion 862 are disposed with a distance therebetween without being in contact with each other, the second recess portion 862 being the recess of the protrusion portion 850. That is, the first wall portion 852 and the second wall portion 854 are disposed with a predetermined distance therebetween without being in contact with each other. In this manner, as illustrated in FIG. 8, the opposing inner wall surfaces of the second recess portion 862 are disposed with a distance therebetween without being in contact with each other, and thus, when the pressurization operation is performed and the flexible membrane 83 is elastically deformed, it is possible to prevent a hindrance of the deformation of the flexible portion 85, particularly, a hindrance of the deformation of the second wall portion 854. For example, in a case where the inner wall surfaces of the second recess portions 862 are brought into contact with each other, that is, in a case where the end portion of the second wall portion 854 toward the second connection portion 855 (the end portion of the second connection portion 855) is brought into contact with the first wall portion 852, when the contact portion 851 moves in the Z direction toward the opening/closing valve B[1], a space when the second wall portion 854 extending in the negative Z direction from the second connection portion 855 is deformed so as to be bent in the positive Z direction, is reduced. As a result, the deformation of the second wall portion 854 is hindered. Even in a case where the end portion of the first wall portion 852 toward the contact portion 851 is brought into contact with a side surface of the second wall portion 854, the deformation of the flexible membrane 83 is hindered. In the present embodiment, side surfaces of the first wall portion 852 and the second wall portion 854 are disposed with a predetermined distance therebetween without being in contact with each other, and thus a hindrance of the deformation of the flexible membrane 83 can be prevented. Therefore, it is possible to deform the flexible membrane 83 by a relatively low pressure.

In the present embodiment, similarly, opposing inner wall surfaces of the first recess portion 861 are also disposed with a predetermined distance therebetween without being in contact with each other. That is, the inner wall surfaces of the first wall portions 852 provided on both sides of the contact portion 851 in the X direction and the Y direction are disposed with a predetermined distance therebetween without being in contact with each other. Thereby, in the pressurization operation, it is possible to secure a space of the flexible membrane 83 when the second wall portion 854 extending in the negative Z direction from the second connection portion 855 is deformed so as to be bent in the positive Z direction, and thus the deformation of the flexible membrane 83 can be easily performed.

In addition, in the present embodiment, similarly, opposing inner wall surfaces of the third recess portion 863 are also disposed with a predetermined distance therebetween without being in contact with each other.

In this manner, in order to configure each of the first recess portion 861 and the second recess portion 862 such that the opposing inner wall surfaces of each of the recess portions are disposed with a distance therebetween without being in contact with each other, for example, in a state before interposing and fixing the flexible membrane 83 between the lid member 81 and the spacer 82, the sum of a volume of the second recess portion 862 (a section thereof is illustrated by $S_1$ in FIG. 5) and a volume of the third recess portion 863 (a section thereof is illustrated by $S_2$ in FIG. 5) may be set to be larger than half of an excluded volume when the flexible membrane 83 is interposed and fixed between the lid member 81 and the spacer 82 toward the valve mechanism 70 (a section thereof is illustrated by $S_3$ in FIG. 5). That is, the fixed portion 84 of the flexible membrane 83 elongates in the X direction and the Y direction by an amount of the excluded volume $S_3$ when the flexible membrane 83 is interposed between the lid member 81 and the spacer 82. Since the elongation of the fixed portion 84 occurs on both sides of the flexible portion 85 side and the opposite side of the flexible portion 85, an amount by which the fixed portion 84 elongates toward the flexible portion 85 is half of the excluded volume $S_3$ of the fixed portion 84. Therefore, when the flexible portion 85 is loosened by the elongation of the fixed portion 84, in order to prevent the opposing inner wall surfaces of each of the second recess portion 862 and the third recess portion 863 from being brought into contact with each other, the sum of the volume $S_1$ of the second recess portion 862 and the volume $S_2$ of the third recess portion 863 may be set to be larger than half (½) of the excluded volume $S_3$ excluded when fixing the flexible membrane 83 $\{(S_1+S_2)>(S_3)/2\}$.

Figure 9:
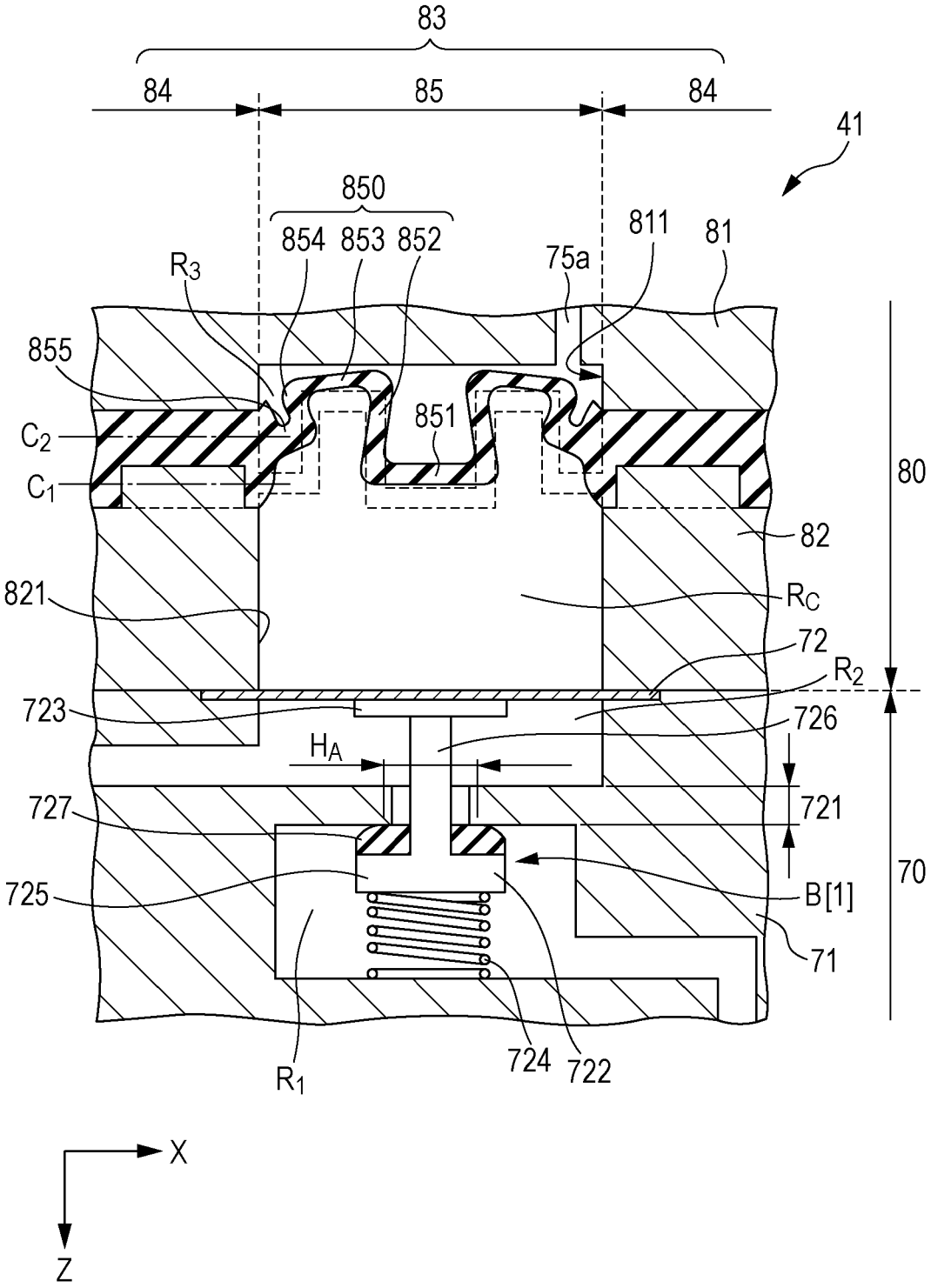
FIG. 9 is a sectional view of a main portion of the flow path unit.

In addition, in the flexible membrane 83 according to the present embodiment, the root of the flexible portion 85, that is, the center of the end portion of the second connection portion 855 connected to the fixed portion 84 is provided to be closer to the opening/closing valve B[1] than the center of the end portion of the fixed portion 84 toward the second connection portion 855 is. In this manner, the center of the root of the flexible portion 85 is provided to be closer to the opening/closing valve B[1] than the center of the fixed portion 84 is, and thus a distance between the flexible portion 85 and the opening/closing valve B[1] in the Z direction can be shortened. Therefore, it is possible to reliably operate the opening/closing valve B[1] by the flexible portion 85. As described above, in a case where the flexible membrane 83 is interposed and fixed between the lid member 81 and the spacer 82, the fixed portion 84 is elongated by interposing the flexible membrane 83. At this time, as illustrated in FIG. 9, when the center $C_1$ of the root of the flexible portion 85 in the Z direction is provided to be closer to the lid member 81 than the center $C_2$ of the end portion of the fixed portion 84 toward the flexible portion 85 is, the flexible portion 85 is deformed so as to protrude toward the lid member 81 by the elongation of the fixed portion 84, and as a result, a distance between the contact portion 851 and the opening/closing valve B[1] increases. In the present embodiment, even when the fixed portion 84 is elongated by interposing and fixing the flexible membrane 83 between the lid member 81 and the spacer 82, the center of the root of the flexible portion 85 is provided to be closer to the opening/closing valve B[1] than the center of the end portion of the fixed portion 84 toward the flexible portion 85 is, and thus the flexible portion 85 can be prevented from being deformed so as to protrude toward the lid member 81. Therefore, it is possible to reliably operate the opening/closing valve B[1] by the flexible portion 85.

As illustrated in FIG. 5, in a state where the deformation of the flexible membrane 83 is released by the depressurization operation, when the pressure in the space $R_2$ is maintained within a predetermined range, the valve body 722 is energized by the spring 724, and thus the sealing portion 727 is brought to close contact with a front surface of the valve seat 721. Therefore, the space $R_1$ and the space $R_2$ are separated from each other. On the other hand, when the pressure in the space $R_2$ is lowered to a value less than a predetermined threshold value due to the ejection of the ink by the liquid ejecting portion 44 or the suction of the ink from the outside, the film 72 is displaced toward the valve seat 721, and thus the pressure receiving plate 723 pressurize the valve shaft 726. As a result, the valve body 722 is moved against the energization by the spring 724, and thus the sealing portion 727 is separated from the valve seat 721. Therefore, the space $R_1$ and the space $R_2$ communicate with each other via the communication hole $H_A$. That is, the film 72 moves according to the pressure difference between a first pressure in the space $R_2$ as the storage chamber and a second pressure in the control chamber $R_C$ outside the storage chamber. The control chamber $R_C$ may be opened to the atmosphere. Accordingly, the film 72 can be moved according to the pressure difference between the atmospheric pressure and the pressure in the space $R_2$.

As described above, when the flexible membrane 83 is deformed according to the pressurization by the pressure adjustment mechanism 18, the film 72 is displaced toward the valve seat 721 according to the pressurization by the flexible membrane 83. Therefore, the valve body 722 is moved according to the pressurization by the pressure receiving plate 723, and thus the opening/closing valve B[1] is opened. In other words, regardless of the level of the pressure in the space $R_2$, it is possible to forcibly open the opening/closing valve B[1] according to the pressurization by the pressure adjustment mechanism 18. That is, the film 72 moves according to a pressure difference between the first pressure in the space $R_2$ as the storage chamber and the second pressure in the control chamber $R_C$, and moves according to the pressing by the flexible membrane 83.

In the present embodiment, the flexible membrane 83 is deformed according to the pressurization by the pressure adjustment mechanism 18, and the film 72 is deformed by the flexible membrane 83. Therefore, the flexible membrane 83 can easily receive the pressure from the pressure adjustment mechanism 18, and thus the flexible membrane 83 can be operated even when the pressure by the pressure adjustment mechanism 18 is relatively low.

In a case where the film 72 is directly pressed by pressurizing the air in the control chamber $R_C$ without providing the flexible membrane 83, unless the pressure in the control chamber $R_C$ is larger than the pressure of the ink in the space $R_2$, the valve body 722 cannot be pressed by the film 72. When the pressure of the ink in the space $R_2$ changes, a required change in the pressure of the pressure adjustment mechanism 18 also increases, and as a result, it becomes difficult to design the pressure adjustment mechanism 18. Here, when it is assumed that the pressure of the air by the pressure adjustment mechanism 18 is Pa (Pa), that the pressure of the ink is Pi (Pa), that the spring force is Fs (N), that the reaction force of the film 72 is F (N), and that the pressure receiving area of the film 72 is A ($m^2$), a required condition for opening the opening/closing valve B[1] is represented by $Pa \cdot A > Pi \times A + Fs + F$, that is, $Pa > Pi + (Fs+F)/A$. As represented by this expression, in order to directly deform the film 72 by the pressure of the pressure adjustment mechanism 18, it is necessary to set the pressure Pa of the pressure adjustment mechanism 18 to be higher than the pressure Pi of the ink.

On the other hand, in the present embodiment, the flexible membrane 83 including the protrusion portion 850 is provided, and thus the area of the flexible membrane 83 toward the space $R_3$ that receives the supply pressure from the pressure adjustment mechanism 18 can be enlarged. Therefore, the flexible membrane 83 can be operated with a relatively low pressure. Accordingly, it is unnecessary that the pressure adjustment mechanism 18 supplies a high pressure to the degassing path 75 and the space $R_3$, and thus a time for which the pressure adjustment mechanism 18 pressurizes the degassing path 75 and the space $R_3$ until the supply pressure from the pressure adjustment mechanism 18 reaches a high pressure is unnecessary. Therefore, it is possible to shorten a time required for the pressurization operation and improve durability of the pressure adjustment mechanism 18. In addition, as the pressure adjustment mechanism 18, a device capable of outputting a high pressure is unnecessary, and thus it is possible to reduce the size and the cost of the pressure adjustment mechanism 18.

On the other hand, as illustrated in FIG. 3, the degassing flow path unit 42 is a structure in which the flow path for supplying the ink passing through the flow path unit 41 to the liquid ejecting portion 44 is formed therein.

Specifically, the degassing flow path unit 42 according to the present embodiment includes a degassing space Q, a filter F[1], a vertical space $R_V$, and a check valve 74. The degassing space Q is a space in which an air bubble extracted from the ink temporarily stays.

The filter F[1] is provided so as to cross the internal flow path for supplying the ink to the liquid ejecting portion 44, and collects air bubbles or foreign matters mixed into the ink. Specifically, the filter F[1] is provided so as to partition a space $R_{F1}$ and a space $R_{F2}$. The upstream space $R_{F1}$ communicates with the space $R_2$ of the flow path unit 41, and the downstream space $R_{F2}$ communicates with the vertical space $R_V$.

A gas-permeable film $M_C$ (an example of a second gas-permeable film) is interposed between the space $R_{F1}$ and the degassing space Q. Specifically, a ceiling surface of the space $R_{F1}$ is configured with the gas-permeable film $M_C$. The gas-permeable film $M_C$ is a gas-permeable film body that transmits gas (air) and does not transmit a liquid such as ink (gas-liquid separation film), and is formed with, for example, a known polymer material. The air bubble collected by the filter F[1] rises by buoyancy and reaches the ceiling surface of the space $R_{F1}$, passes through the gas-permeable film $M_C$, and is discharged to the degassing space Q. In other words, the air bubble mixed into the ink is separated.

The vertical space $R_V$ is a space for temporarily storing the ink. In the vertical space $R_V$ according to the first embodiment, an inflow port $V_{in}$ into which the ink passing through the filter F[1] flows from the space $R_{F2}$, and outflow ports $V_{out}$ through which the ink flows out toward the nozzles N are formed. In other words, the ink in the space $R_{F2}$ flows into the vertical space $R_V$ via the inflow port $VI_{in}$, and the ink in the vertical space $R_V$ flows into the liquid ejecting portion 44 (manifold $S_R$) via the outflow ports $V_{out}$. As illustrated in FIG. 3, the inflow port $V_{in}$ is positioned at a position higher than the outflow ports $V_{out}$ in the vertical direction (negative Z-direction).

A gas-permeable film $M_A$ (an example of a first gas-permeable film) is interposed between the vertical space $R_V$ and the degassing space Q. Specifically, a ceiling surface of the vertical space $R_V$ is configured with the gas-permeable film $M_A$. The gas-permeable film $M_A$ is a gas-permeable film body that is similar to the gas-permeable film $M_C$ described above. Accordingly, the air bubble, which passes through the filter F[1] and enters into the vertical space $R_V$, rises by the buoyancy, passes through the gas-permeable film $M_A$ of the ceiling surface of the vertical space $R_V$, and is discharged to the degassing space Q. As described above, the inflow port $V_{in}$ is positioned at a position higher than the outflow ports $V_{out}$ in the vertical direction, and thus the air bubble can effectively reach the gas-permeable film $M_A$ of the ceiling surface using the buoyancy in the vertical space $R_V$.

In the manifold $S_R$ of the liquid ejecting portion 44, as described above, the inflow port $R_{in}$ into which the ink supplied from the outflow port $V_{out}$ of the vertical space $R_V$ flows is formed. In other words, the ink that flowed out from the outflow port $V_{out}$ of the vertical space $R_V$ flows into the manifold $S_R$ via the inflow port $R_{in}$, and is supplied to each pressure chamber $S_C$ through the opening portion 481A. In the manifold $S_R$ according to the first embodiment, a discharge port $R_{out}$ is formed. The discharge port $R_{out}$ is a flow path that is formed on the ceiling surface 49 of the manifold $S_R$. As illustrated in FIG. 3, the ceiling surface 49 of the manifold $S_R$ is an inclined surface (a flat surface or a curved surface) which rises from the inflow port $R_{in}$ side to the discharge port $R_{out}$ side. Therefore, the air bubble that is entered from the inflow port $R_{in}$ is guided to the discharge port $R_{out}$ side along the ceiling surface 49 by the action of the buoyancy.

A gas-permeable film $M_B$ (an example of a first gas-permeable film) is interposed between the manifold $S_R$ and the degassing space Q. The gas-permeable film $M_B$ is a gas-permeable film body that is similar to the gas-permeable film $M_A$ or the gas-permeable film $M_C$. Therefore, the air bubble that is entered from the manifold $S_R$ to the discharge port $R_{out}$ rises by the buoyancy, passes through the gas-permeable film $M_B$, and is discharged to the degassing space Q. As described above, the air bubble in the manifold $S_R$ is guided to the discharge port $R_{out}$ along the ceiling surface 49, and thus it is possible to effectively discharge the air bubble in the manifold $S_R$, compared to a configuration in which, for example, the ceiling surface 49 of the manifold $S_R$ is a horizontal plane. The gas-permeable film $M_A$, the gas-permeable film $M_B$, and the gas-permeable film $M_C$ may be formed with a single film body.

As described above, in the present embodiment, the gas-permeable film $M_A$ is interposed between the vertical space $R_V$ and the degassing space Q, the gas-permeable film $M_B$ is interposed between the manifold $S_R$ and the degassing space Q, and the gas-permeable film $M_C$ is interposed between the space $R_{F1}$ and the degassing space Q. In other words, the air bubbles, which pass through each of the gas-permeable film $M_A$, the gas-permeable film $M_B$, and the gas-permeable film $M_C$, reach the common degassing space Q. Therefore, there is an advantage in that a structure for discharging the air bubbles is simplified, compared to a configuration in which the air bubbles extracted in each unit of the liquid ejecting unit 40 are supplied to each individual space.

As illustrated in FIG. 3, the degassing space Q communicates with the degassing path 75. The degassing path 75 is a path for discharging the air stayed in the degassing space Q to the outside of the apparatus. The check valve 74 is interposed between the degassing space Q and the degassing path 75. The check valve 74 is a valve mechanism that allows a circulation of air directed to the degassing path 75 from the degassing space Q and that inhibits a circulation of air directed to the degassing space Q from the degassing path 75.

Figure 10:
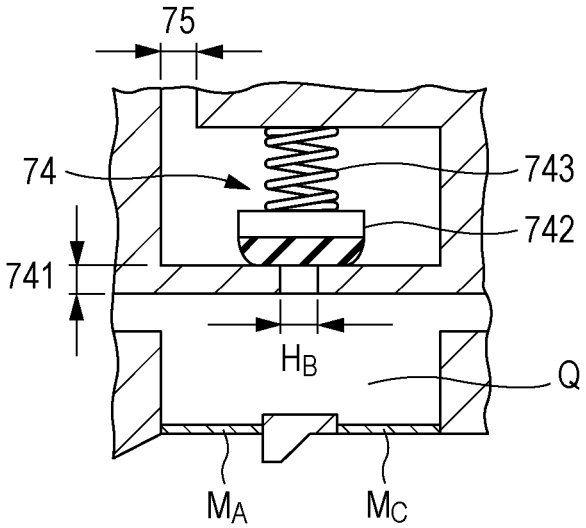
FIG. 10 is a diagram explaining a degassing space and a check valve.

FIG. 10 is an explanatory diagram focusing on the vicinity of the check valve 74 of the degassing flow path unit 42. As illustrated in FIG. 10, the check valve 74 according to the first embodiment includes a valve seat 741, a valve body 742, and a spring 743. The valve seat 741 is a flat plate-shaped portion that partitions the degassing space Q and the degassing path 75. In the valve seat 741, a communication hole $H_B$ through which the degassing space Q and the degassing path 75 communicate with each other is formed. The valve body 742 is opposite to the valve seat 741, and is energized toward the valve seat 741 by the spring 743. In a state where the pressure in the degassing path 75 is maintained to a pressure equal to or greater than the pressure in the degassing space Q (state where the inside of the degassing path 75 is opened to the atmosphere or is pressurized), the valve body 742 is brought to close contact with the valve seat 741 by the energization of the spring 743, and thus the communication hole $H_B$ is closed. Therefore, the degassing space Q and the degassing path 75 are separated from each other. On the other hand, in a state where the pressure in the degassing path 75 is less than the pressure in the degassing space Q (state where the inside of the degassing path 75 is depressurized), the valve body 742 is separated from the valve seat 741 against the energization by the spring 743. Therefore, the degassing space Q and the degassing path 75 communicate with each other via the communication hole $H_B$.

The degassing path 75 according to the present embodiment is connected to the path for coupling the pressure adjustment mechanism 18 and the control chamber $R_C$ of the flow path unit 41. In other words, the path connected to the pressure adjustment mechanism 18 is branched into two systems, and one of the two systems is connected to the control chamber $R_C$ and the other of the two systems is connected to the degassing path 75.

As illustrated in FIG. 3, a discharge path 76 that starts from the liquid ejecting unit 40 and reaches the inside of the distribution flow path 36 via the flow path unit 41 is formed. The discharge path 76 is a path that communicates with the internal flow path of the liquid ejecting unit 40 (specifically, the flow path for supplying the ink to the liquid ejecting portion 44). Specifically, the discharge path 76 communicates with the discharge port $R_{out}$ of the manifold $S_R$ of each liquid ejecting portion 44 and the vertical space $R_V$.

An end portion of the discharge path 76 that is opposite to the liquid ejecting unit 40 is connected to a closing valve 78. A position at which the closing valve 78 is provided is arbitrary. In FIG. 3, a configuration in which the closing valve 78 is provided in the distribution flow path 36 is illustrated. The closing valve 78 is a valve mechanism that can close the discharge path 76 in a normal state (normally close) and temporarily open the discharge path 76 to the atmosphere.

Figure 11:
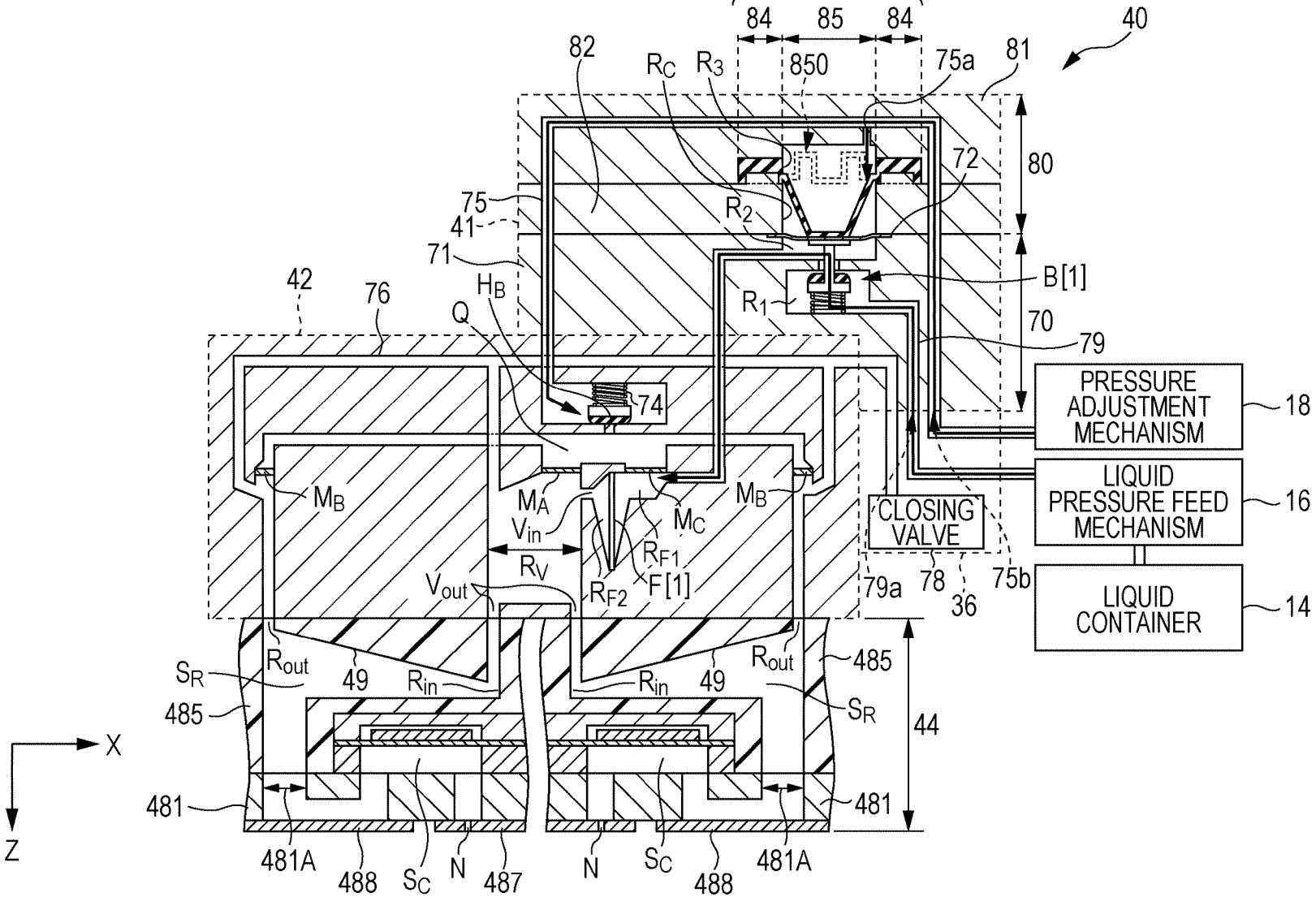
FIG. 11 is a diagram explaining a state of the liquid ejecting head in an initial filling.

An operation of the liquid ejecting unit 40 will be described focusing on the discharge of the air bubble from the internal flow path. As illustrated in FIG. 11, in a stage of initially filling the liquid ejecting unit 40 with the ink (hereinafter, referred to as "initial filling"), the pressure adjustment mechanism 18 executes the pressurization operation. In other words, the inside of the degassing path 75 of the valve mechanism 70 is pressurized by the supply of air. Therefore, the flexible membrane 83 in the control chamber $R_C$ is elastically deformed toward the film 72, and thus the film 72 and the pressure receiving plate 723 are displaced. As a result, the valve body 722 is moved according to the pressurization by the pressure receiving plate 723, and thus the space $R_1$ and the space $R_2$ communicate with each other. In a state where the degassing path 75 is pressurized, the degassing space Q and the degassing path 75 are separated from each other by the check valve 74, and thus the air in the degassing path 75 does not flow into the degassing space Q. On the other hand, in the initial filling stage, the closing valve 78 is opened.

In the above state, the liquid pressure feed mechanism 16 pressure-feeds the ink stored in the liquid container 14 to the internal flow path of the liquid ejecting unit 40. Specifically, the ink that is pressure-fed from the liquid pressure feed mechanism 16 is supplied to the vertical space $R_V$ via the opening/closing valve B[1] in the open state, and is supplied from the vertical space $R_V$ to the manifold $S_R$ and each pressure chamber $S_C$. As described above, since the closing valve 78 is opened, the air that is present in the internal flow path before the execution of the initial filling passes through the discharge path 76 and the closing valve 78, and is discharged to the outside of the apparatus, at the same timing of filling the internal flow path and the discharge path 76 with the ink. Therefore, the entire internal flow path including the manifold $S_R$ and each pressure chamber $S_C$ of the liquid ejecting unit 40 is filled with the ink, and thus the nozzles N can eject the ink by the operation of the piezoelectric actuator 484. As described above, in the first embodiment, the closing valve 78 is opened when the ink is pressure-fed from the liquid pressure feed mechanism 16 to the liquid ejecting unit 40, and thus it is possible to efficiently fill the internal flow path of the liquid ejecting unit 40 with the ink. When the initial filling described above is completed, the pressurization operation by the pressure adjustment mechanism 18 is stopped, and the closing valve 78 is closed.

Figure 12:
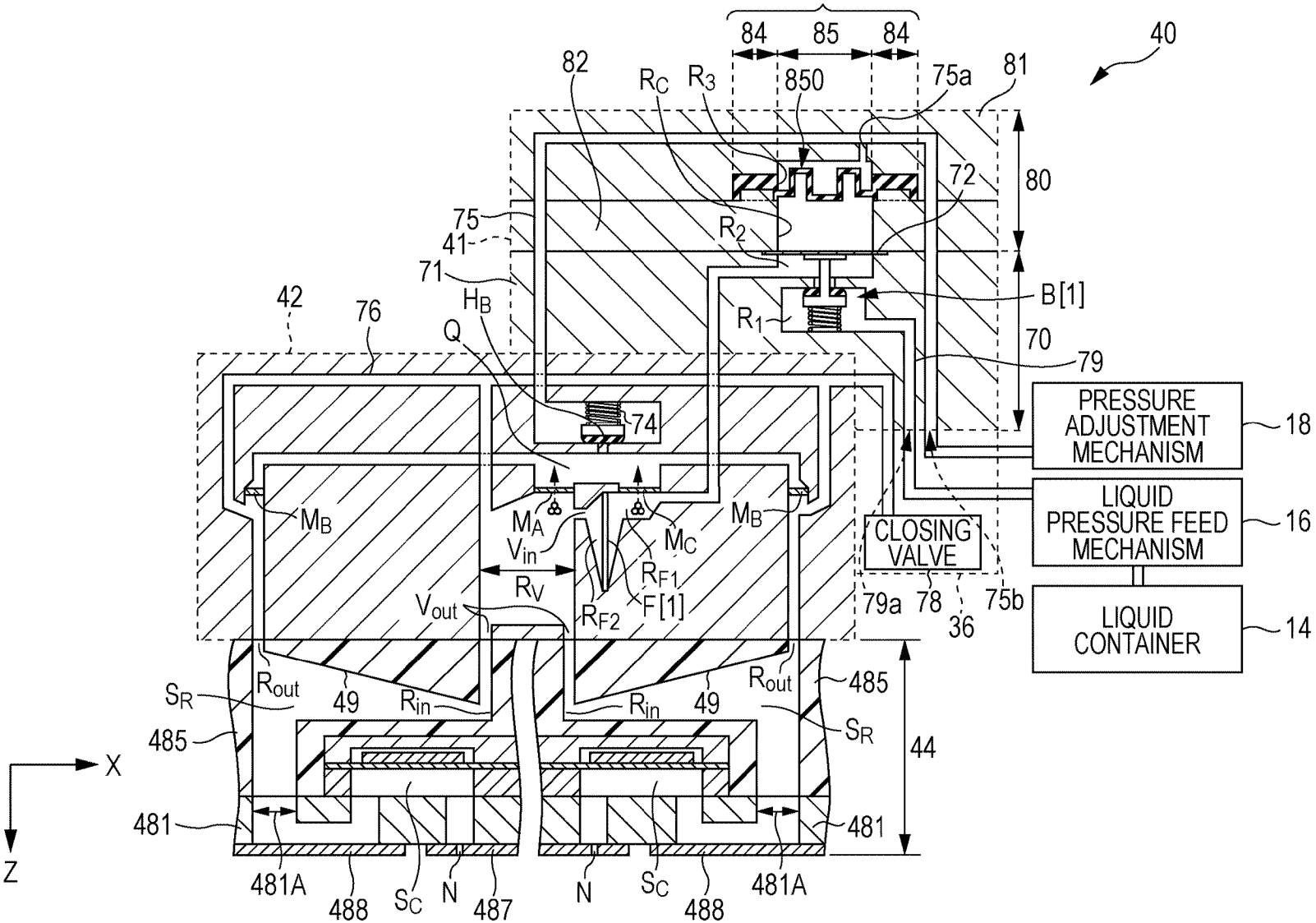
FIG. 12 is a diagram explaining a state of the liquid ejecting head in a normal use.

As illustrated in FIG. 12, in a state where the initial filling is completed and thus the liquid ejecting apparatus 100 can be used, the air bubble that is present in the internal flow path of the liquid ejecting unit 40 is discharged to the degassing space Q at all times. More specifically, the air bubble in the space $R_{F1}$ is discharged to the degassing space Q via the gas-permeable film $M_C$, the air bubble in the vertical space $R_V$ is discharged to the degassing space Q via the gas-permeable film $M_A$, and the air bubble in the manifold $S_R$ is discharged to the degassing space Q via the gas-permeable film $M_B$. On the other hand, the opening/closing valve B[1] is closed in a state where the pressure in the space $R_2$ is maintained within a predetermined range, and is opened in a state where the pressure in the space $R_2$ is less than a predetermined threshold value. When the opening/closing valve B[1] is opened, the ink supplied from the liquid pressure feed mechanism 16 flows from the space $R_1$ to the space $R_2$, and as a result, the pressure of the space $R_2$ increases. Thus, the opening/closing valve B[1] is closed.

Figure 13:
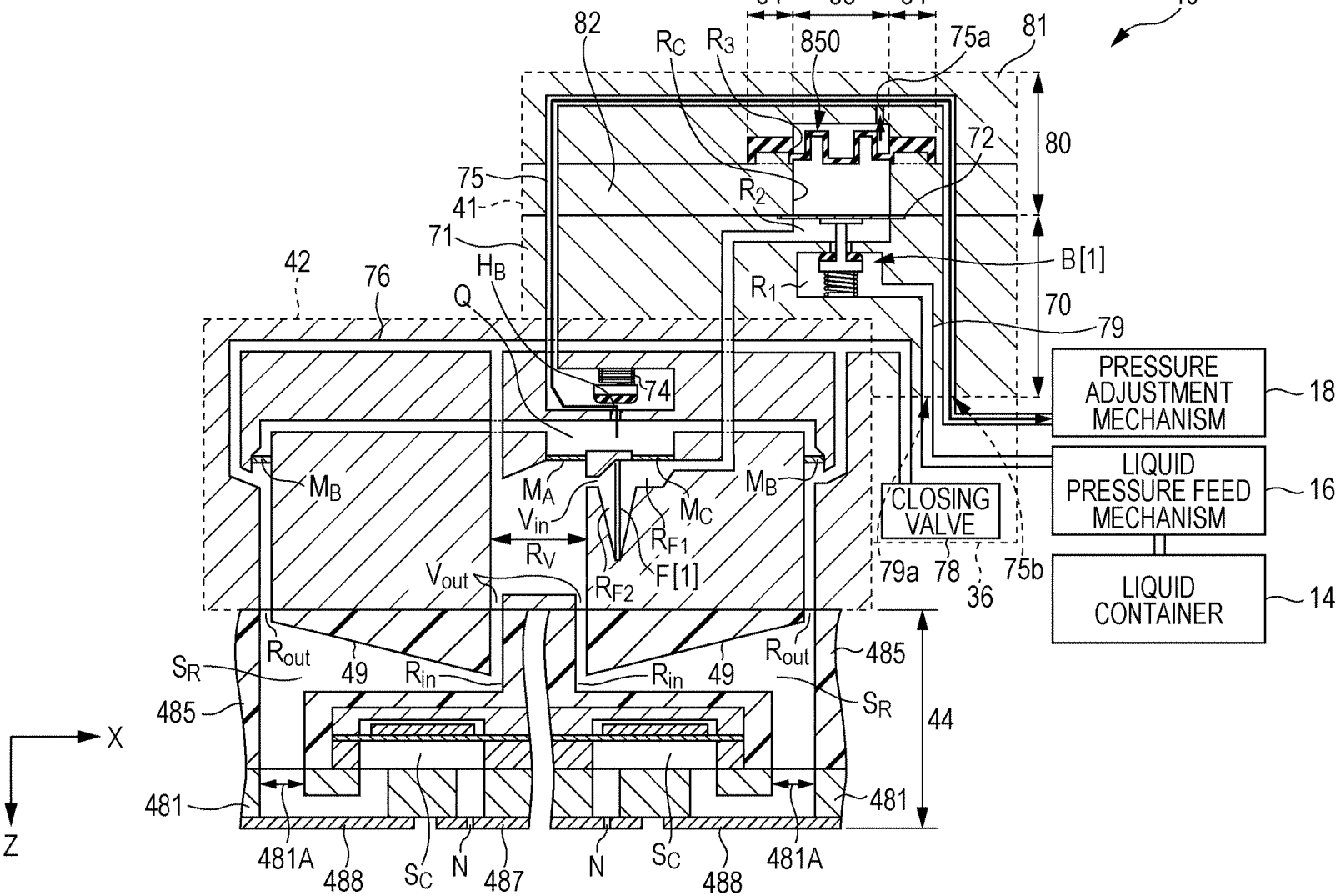
FIG. 13 is a diagram explaining a state of the liquid ejecting head in a degassing operation.

In the operation state illustrated in FIG. 12, the air stayed in the degassing space Q is discharged to the outside of the apparatus by the degassing operation. The degassing operation is executed at any period of time, for example, such as immediately after the power-on of the liquid ejecting apparatus 100, during a period of the printing operation, or the like. FIG. 13 is an explanatory diagram of a degassing operation. As illustrated in FIG. 13, when the degassing operation is started, the pressure adjustment mechanism 18 executes the depressurization operation. In other words, the space $R_3$ and the degassing path 75 are depressurized by the suction of air.

When the degassing path 75 is depressurized, the valve body 742 of the check valve 74 is separated from the valve seat 741 against the energization by the spring 743, and the degassing space Q and the degassing path 75 communicate with each other via the communication hole $H_B$ (refer to FIG. 10). Therefore, the air in the degassing space Q is discharged to the outside of the apparatus via the degassing path 75. On the other hand, although the flexible membrane 83 is deformed toward the opposite side of the film 72 by depressurization in the internal space, there is no influence on the pressure in the control chamber $R_C$ (further, the film 72), and thus the opening/closing valve B[1] is maintained in a state of being closed.

As described above, in the present embodiment, the flexible membrane mechanism 80, which is used for the valve mechanism 70, includes the lid member 81, the flexible membrane 83 that forms the space $R_3$ between the flexible membrane 83 and the lid member 81, and the degassing path 75 that is a fluid flow path communicating with the space $R_3$. The flexible membrane 83 includes the protrusion portion 850 that becomes the projection toward the lid member 81 and becomes the recess (second recess portion 862) toward the opposite side of the projection. The opening/closing valve B[1] of the valve mechanism 70 is opened and closed by the deformation of the flexible membrane 83. In this manner, the protrusion portion 850 is provided on the flexible membrane 83, and thus, in the flexible membrane 83, the area by which the pressure from the pressure adjustment mechanism 18 is received via the degassing path 75 as a fluid flow path, is increased. Therefore, the flexible membrane 83 can be operated by a relatively low pressure. In particular, the protrusion portion 850 which is the recess/projection of the flexible membrane 83 can be deformed so as to be widened, and thus the flexible membrane 83 can be deformed by a relatively low pressure, compared to a case where the flexible membrane 83 is deformed and elongated by making the thickness of the flexible membrane 83 thin. Thus, it is possible to operate the opening/closing valve B[1] by the flexible membrane 83. Therefore, a relatively high pressure is not required as the supply pressure, and thus a time for which the pressure adjustment mechanism 18 pressurizes the degassing path 75 and the space $R_3$ until the supply pressure reaches a high pressure is unnecessary. Accordingly, it is possible to shorten a time required for the pressurization operation and improve durability of the pressure adjustment mechanism 18.

In addition, in the present embodiment, the flexible membrane 83 includes the fixed portion 84 that is fixed at the outside of the space $R_3$ and the flexible portion 85 that is extended from the fixed portion 84 into the space $R_3$. The length $L_2$ from the root of the flexible portion 85 toward the fixed portion 84 to the contact position between the flexible portion 85 and the opening/closing valve B[1] of the valve mechanism 70 is longer than the shortest distance $L_1$ from the root of the flexible portion 85 of the flexible membrane 83 toward the fixed portion 84 to the position at which the flexible portion 85 is brought into contact with the opening/closing valve B[1]. In the present embodiment, the length from the fixed portion 84 to the contact portion 851 of the flexible portion 85, that is, the total length $L_2$ of the first wall portion 852, the first connection portion 853, the second wall portion 854, and the second connection portion 855, is set to be longer than the shortest distance $L_1$. In this manner, the length $L_2$ from the root of the flexible portion 85 toward the fixed portion 84 to the contact position between the flexible portion 85 and the opening/closing valve B[1] of the valve mechanism 70 is longer than the shortest distance $L_1$, and thus, when the protrusion portion 850 of the flexible portion 85 of the flexible membrane 83 is deformed so as to be widened, the opening/closing valve B[1] can be reliably pressed and operated by the flexible portion 85. In addition, the opening/closing valve B[1] can be operated only by deforming the protrusion portion 850 of the flexible portion 85 so as to be widened, and thus the opening/closing valve B[1] can be operated by a low pressure, compared to a case where the flexible portion 85 is elongated by making the thickness of the flexible portion 85 thin. The length $L_2$ of the flexible membrane 83 may be shorter than the shortest distance $L_1$. On the other hand, in order to operate the opening/closing valve B[1] by deforming the flexible membrane 83, it is necessary to deform the protrusion portion 850 so as to be widened and to deform the flexible membrane 83 so as to be elongated, and this results in an increase in operation pressure. Here, even in a case where the length $L_2$ of the flexible membrane 83 is shorter than the shortest distance $L_1$, the flexible membrane 83 can be elastically deformed by a low pressure compared to a case where a flat plate-shaped flexible membrane is used.

In addition, in the present embodiment, the flexible membrane 83 is interposed and fixed between the lid member 81 and the spacer 82 which is a member provided on a surface of the lid member 81 toward the flexible membrane 83, and the opposing inner wall surfaces of the second recess portion 862 which is a recess of the flexible membrane 83 are disposed with a distance therebetween without being in contact with each other. Therefore, when the protrusion portion 850 of the flexible membrane 83 is deformed so as to be widened, the inner wall surfaces of the second recess portion 862 can be prevented from contacting with each other. Thus, a hindrance of the deformation of the flexible membrane 83 can be prevented, and thereby the flexible membrane 83 can be deformed by a relatively low pressure.

The opposing inner wall surfaces of the second recess portion 862 may be brought into contact with each other. On the other hand, in order to deform the flexible membrane 83, a relatively high pressure is required, compared to a case where the opposing inner wall surfaces of the second recess portion 862 are not brought into contact with each other.

In addition, in the present embodiment, the flexible membrane 83 includes the fixed portions 84 and the flexible portion 85, the fixed portion 84 being interposed and fixed between the lid member 81 outside the space $R_3$ and the spacer 82 which is a member provided on the surface of the lid member 81 toward the flexible membrane 83, and the flexible portion 85 being extended from the fixed portion 84 into the space $R_3$. In the Z direction in which the fixed portion 84 of the flexible membrane 83 is interposed, the center $C_1$ of the end portion of the flexible portion 85 toward the fixed portion 84 is set to be closer to the opening/closing valve B[1] than the center $C_2$ of the end portion of the fixed portion 84 toward the flexible portion 85 is. Thereby, the fixed portion 84 is elongated by interposing and fixing the fixed portion 84, and thus the flexible portion 85 can be prevented from being deformed so as to protrude toward the lid member 81. Therefore, it is possible to prevent an increase in distance between the flexible portion 85 and the opening/closing valve B[1]. Accordingly, it is possible to reliably operate the opening/closing valve B[1] by the flexible membrane 83, and to reduce the size of the flexible membrane mechanism 80 in the Z direction.

In addition, in the present embodiment, the flexible membrane mechanism 80 includes the spacer 82 for maintaining a constant distance between the film 72 of the valve mechanism 70 and the flexible membrane 83, the spacer 82 being provided with the space $R_2$ which is a chamber communicating with the opening/closing valve B[1] and the film 72 which defines a part of the space $R_2$ and is deformed such that the opening/closing valve B[1] is opened or closed. In this manner, a constant distance is maintained between the film 72 and the flexible membrane 83 by the spacer 82. Thus, in a state where the flexible membrane 83 is not operated, a hindrance of the function of the film 72 by the flexible membrane 83 can be prevented. In addition, when the flexible membrane 83 is deformed, the film 72 can be reliably pressed.

In the present embodiment, although the spacer 82 is provided in the flexible membrane mechanism 80, the spacer 82 may be provided in the valve mechanism 70. In addition, the spacer 82 may be provided integrally with the valve mechanism housing 71 and the lid member 81.

In addition, in the present embodiment, the pressure adjustment mechanism 18 is commonly used in the opening/closing of the opening/closing valve B[1] and the opening/closing of the check valve 74, and thus it is possible to simplify the configuration for controlling the opening/closing valve B[1] and the check valve 74, compared to a configuration in which the opening/closing valve B[1] and the check valve 74 are controlled by each individual mechanism.

Further, in the present embodiment, the pressure receiving plate 723 is provided on the film 72. Therefore, when the flexible membrane 83 presses the film 72, it is possible to prevent deformation of the film 72 such as extension or tear of the film 72. In addition, the pressure receiving plate 723 is provided on the valve body 722 side, and thus it is possible to prevent the valve body 722 from being brought into direct contact with the film 72, thereby preventing deformation and breakage of the film 72 due to contact between the film 72 and the valve body 722. The pressure receiving plate 723 may not be provided.

Further, the liquid ejecting unit 40 according to the present embodiment includes the flow path unit 41 as the flow path structure, and the liquid ejecting portion 44 that changes the first pressure by ejecting the ink in the space $R_2$ as the storage chamber. Even though the ink in the space $R_2$ is consumed by ejection of the ink in the space $R_2$ by the liquid ejecting portion 44, the film 72 operates based on the pressure in the space $R_2$, and thus it is possible to supply the ink from the space $R_1$ into the space $R_2$ by opening the opening/closing valve B[1]. Accordingly, it is possible to supply the ink to the liquid ejecting portion 44 with a constant pressure.

Second Embodiment

Figure 14:
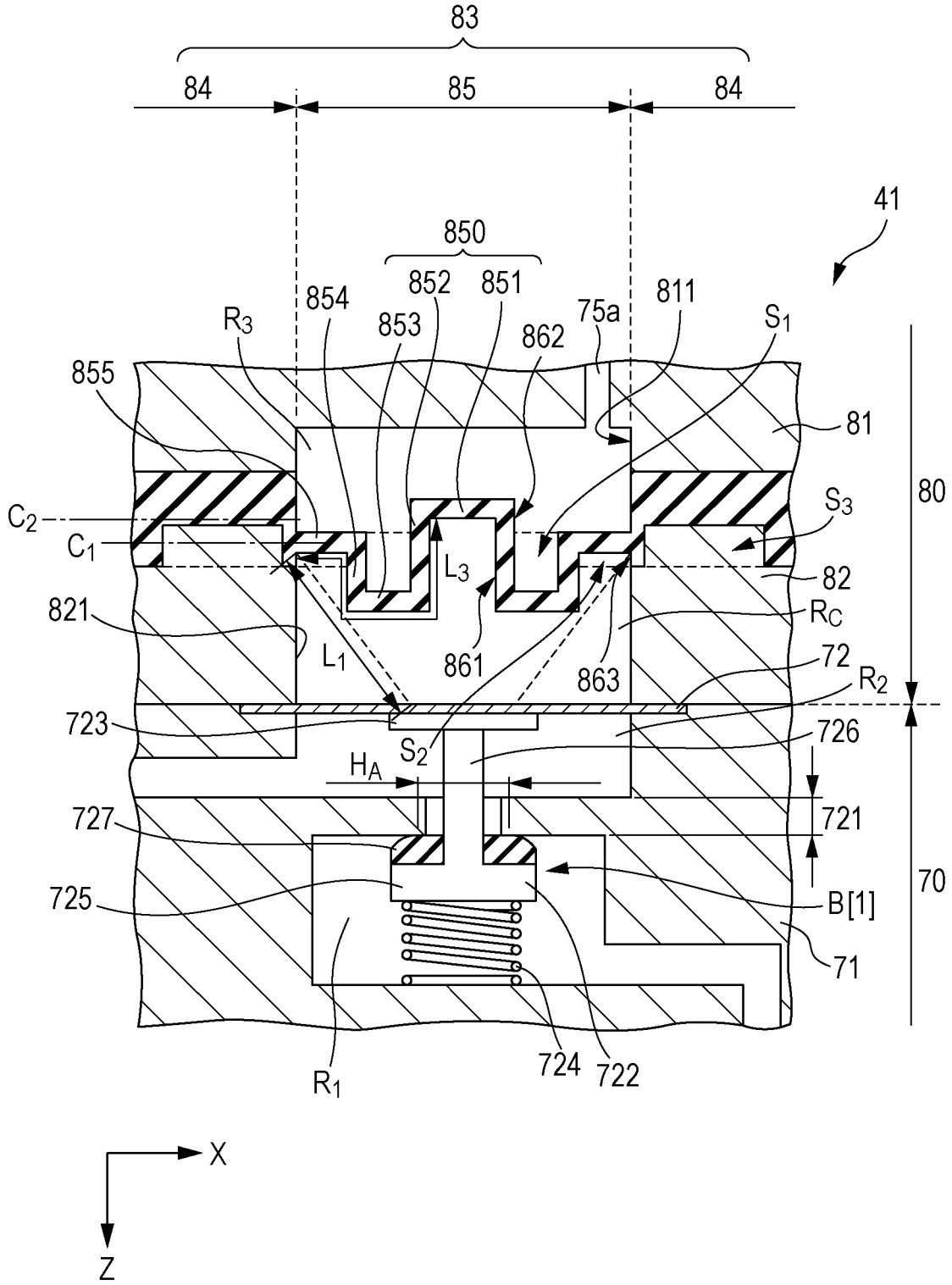
FIG. 14 is a sectional view of a main portion of the flow path unit according to a second embodiment.
Figure 15:
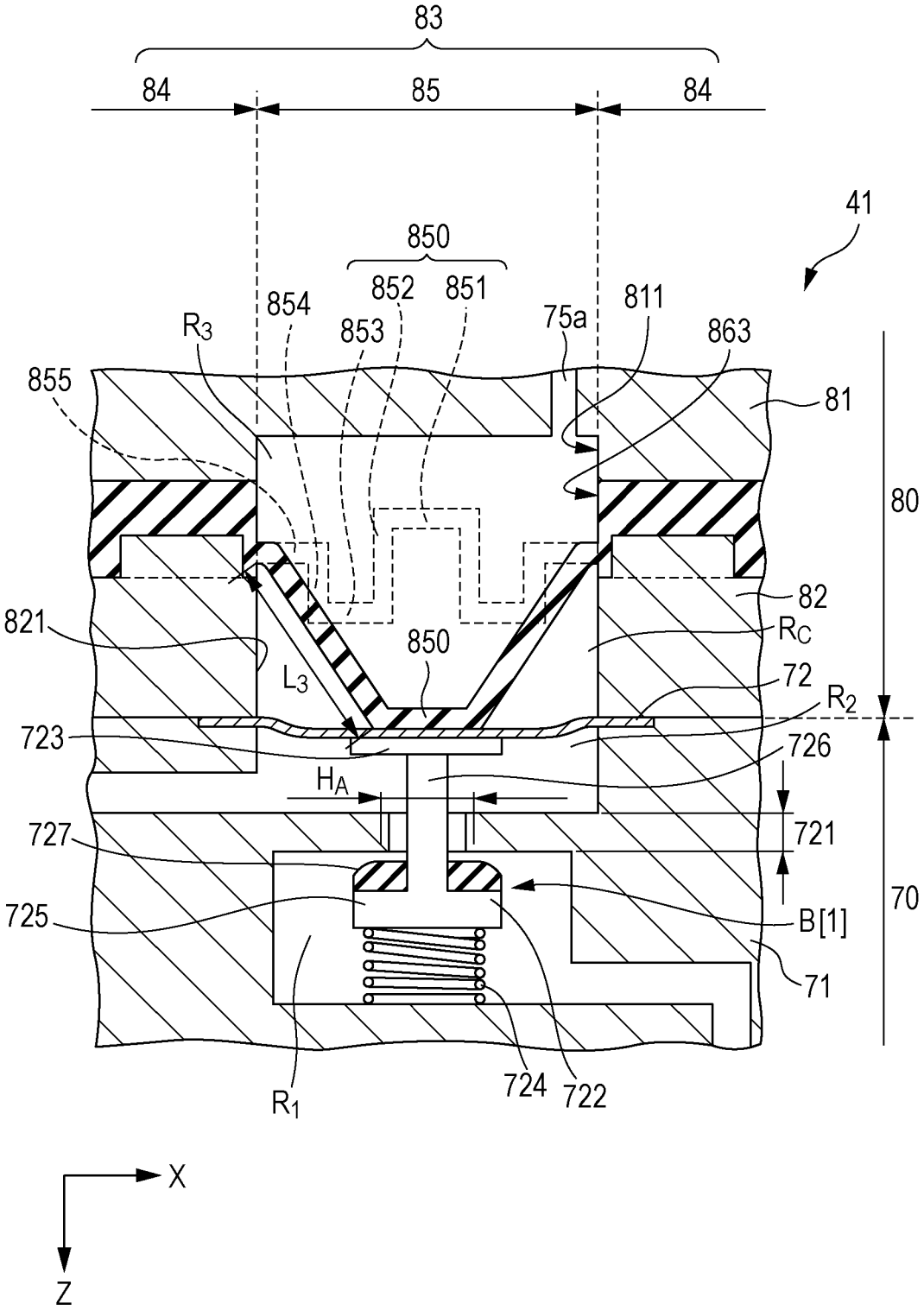
FIG. 15 is a sectional view of a main portion of the flow path unit according to the second embodiment.

FIGS. 14 and 15 are sectional views of a main portion of the flow path unit according to a second embodiment of the invention, FIG. 14 is a view illustrating a state in the depressurization operation, and FIG. 15 is a view illustrating a state in the pressurization operation. The same reference numerals are given to the same members as those of the embodiment described above, and a repeated description thereof will be omitted.

As illustrated in FIG. 14, the flexible membrane 83 according to the present embodiment includes the fixed portions 84 that are interposed and fixed between the lid member 81 and the spacer 82 in the Z direction, and the flexible portion 85 that partitions the space $R_3$ and the control chamber $R_C$.

In the depressurization operation, the flexible portion 85 includes a contact portion 851, a first wall portion 852, a first connection portion 853, a second wall portion 854, and a second connection portion 855. The contact portion 851, the first wall portion 852, the first connection portion 853, the second wall portion 854, and the second connection portion 855 that constitute the flexible portion 85 have substantially the same thickness, and the fixed portion 84 is thicker than the flexible portion 85.

Similar to the first embodiment described above, the contact portion 851 extends along a plane direction including the X direction and the Y direction.

The first wall portion 852 is provided in a continuous annular shape around the contact portion 851. The first wall portion 852 is erectly provided to be closer to the film 72 than the contact portion 851 is. Specifically, one end of the first wall portion 852 is connected to the contact portion 851, and the other end of the first wall portion 852 is extended along the Z direction so as to be closer to the film 72 than the contact portion 851 is.

The first connection portion 853 is provided in a continuous annular shape around the first wall portion 852. One end of the first connection portion 853 is connected to the other end of the first wall portion 852 that is positioned toward the film 72, and the other end of the first connection portion 853 is extended along the X direction and the Y direction so as to be positioned outside the first wall portion 852.

The second wall portion 854 is provided in a continuous annular shape around the first connection portion 853. The second wall portion 854 is erectly provided to be closer to the opposite side of the film 72, that is, to be closer to the lid member 81 than the first connection portion 853 is. Specifically, one end of the second wall portion 854 is connected to the first connection portion 853, and the other end of the second wall portion 854 is extended along the Z direction so as to be positioned at a position closer to the lid member 81 than the first connection portion 853 is and closer to the film 72 than the contact portion 851 is.

The second connection portion 855 is provided in a continuous annular shape around the second wall portion 854. One end of the second connection portion 855 is connected to the other end of the second wall portion 854, and the other end of the second connection portion 855 is extended along the X direction as a first direction and the Y direction as a second direction so as to be positioned outside the second wall portion 854. In addition, the other end of the second connection portion 855, which is opposite to one end of the second connection portion 855 connected to the second wall portion 854, is connected to the fixed portion 84. That is, the second connection portion 855 connects the fixed portion 84 and the second wall portion 854. In the flexible membrane 83, in the Z direction in which the fixed portion 84 is interposed between the lid member 81 and the spacer 82, a root of the flexible portion 85 toward the fixed portion 84, that is, the center $C_1$ of the end portion of the second connection portion 855 toward the fixed portion 84, is provided at a position closer to the opening/closing valve B[1] than the center $C_2$ of the end portion of the fixed portion 84 toward the flexible portion 85 is.

In this manner, a bellows is formed around the contact portion 851 by the first wall portion 852, the first connection portion 853, the second wall portion 854, and the second connection portion 855, which have the same center and have an annular shape. That is, on the flexible portion 85 according to the present embodiment, a first recess portion 861 which is opened toward the film 72 is provided by the contact portion 851 and the first wall portion 852 provided around the contact portion 851. In addition, around the first recess portion 861, a second recess portion 862, which is opened toward the lid member 81 by the first wall portion 852, the first connection portion 853, and the second wall portion 854, is provided in a continuous annular shape in a circumferential direction thereof. Further, around the second recess portion 862, a third recess portion 863, which is opened toward the film 72 by the second wall portion 854, the second connection portion 855, and the fixed portion 84, is provided in a continuous annular shape in a circumferential direction thereof. The first recess portion 861, the second recess portion 862, and the third recess portion 863 are provided at positions not overlapping with each other when viewed from the Z direction in plan view, and a bellows is formed by the recess portions. That is, in the present embodiment, the contact portion 851 and the first wall portion 852 of the flexible portion 85 form the protrusion portion 850, which becomes the projection toward the lid member 81 and becomes the recess toward the film 72 (the second recess portion 862).

In addition, in the present embodiment, opposing inner wall surfaces of the first recess portion 861 are disposed with a distance therebetween without being in contact with each other, the first recess portion 861 being recessed toward the film 72 by the protrusion portion 850. That is, the inner wall surfaces of the first wall portions 852 provided on both sides of the contact portion 851 in a direction including the X direction and the Y direction are disposed with a predetermined distance therebetween without being in contact with each other. In the present embodiment, similar to the first recess portion 861, opposing inner wall surfaces of each of the second recess portion 862 and the third recess portion 863 are disposed with a predetermined space therebetween without being in contact with each other. In order to make the first recess portion 861 such that the opposing inner wall surfaces thereof are disposed with a distance therebetween without being in contact with each other as described above, similar to the first embodiment described above, the sum of the volume of the second recess portion 862 (a section thereof is illustrated by $S_1$) and the volume of the third recess portion 863 (a section thereof is illustrated by $S_2$) may be set to be equal to or larger than half of the excluded volume $S_3$ excluded when fixing the fixed portion 84.

Further, in the flexible membrane 83, a length $L_3$ from the root of the flexible portion 85 toward the fixed portion 84 to the contact position between the flexible portion 85 and the opening/closing valve B[1], in the present embodiment, the total length $L_3$ of the first wall portion 852, the first connection portion 853, the second wall portion 854, and the second connection portion 855, is longer than the shortest distance $L_1$ between the root of the flexible portion 85 of the flexible membrane 83 and the opening/closing valve B[1].

When the flexible membrane 83 is pressurized by the pressurization operation of the pressure adjustment mechanism 18, as illustrated in FIG. 15, the flexible portion 85 of the flexible membrane 83 is elastically deformed such that the contact portion 851 moves toward the film 72. In other words, the flexible portion 85 is elastically deformed such that the first recess portion 861 formed by the contact portion 851 and the first wall portion 852 forming the bellows is expanded, and thus the contact portion 851 moves toward the opening/closing valve B[1]. That is, the first wall portion 852 extending from the first connection portion 853 in the negative Z direction is elastically deformed so as to be bent in the positive Z direction, and thus the contact portion 851 moves toward the opening/closing valve B[1]. The contact portion 851 that is moved toward the film 72 is brought into contact with the film 72, and presses the film 72 in the positive Z direction. Thus, the opening/closing valve B[1] is opened.

Even in the flexible membrane 83, similar to the first embodiment described above, the area by which the flexible membrane 83 receives the pressure from the degassing path 75 as a fluid flow path, is increased. Therefore, the flexible membrane 83 can be operated by a relatively low pressure.

In addition, the length $L_3$ from the root of the flexible portion 85 toward the fixed portion 84 to the contact position between the flexible portion 85 and the opening/closing valve B[1] of the valve mechanism 70 is longer than the shortest distance $L_1$, and thus, when the protrusion portion 850 of the flexible portion 85 of the flexible membrane 83 is deformed so as to be widened, the opening/closing valve B[1] can be reliably pressed and operated by the flexible portion 85.

In addition, in the present embodiment, the flexible membrane 83 is interposed and fixed between the lid member 81 and the spacer 82, and the opposing inner wall surfaces of the first recess portion 861 which is a recess of the flexible membrane 83 are disposed with a distance therebetween without being in contact with each other. Thus, a hindrance of the deformation of the flexible membrane 83 can be prevented.

In addition, as illustrated in FIG. 14, the center $C_1$ of the end portion of the flexible portion 85 toward the fixed portion 84 is positioned at a position closer to the opening/closing valve B[1] than the center $C_2$ of the end portion of the fixed portion 84 toward the flexible portion 85 is. Thus, the fixed portion 84 is elongated by interposing and fixing the fixed portion 84. Therefore, the flexible portion 85 can be prevented from being deformed so as to protrude toward the lid member 81, and thus it is possible to prevent an increase in distance between the flexible portion 85 and the opening/closing valve B[1].

In this embodiment, the contact portion 851 is positioned at a position closer to the lid member 81, that is, in the negative Z direction, than the second connection portion 855 is, and the position of the contact portion 851 is not particularly limited thereto. Here, a modification example of the flexible membrane is illustrated in FIG. 16.

Figure 16:
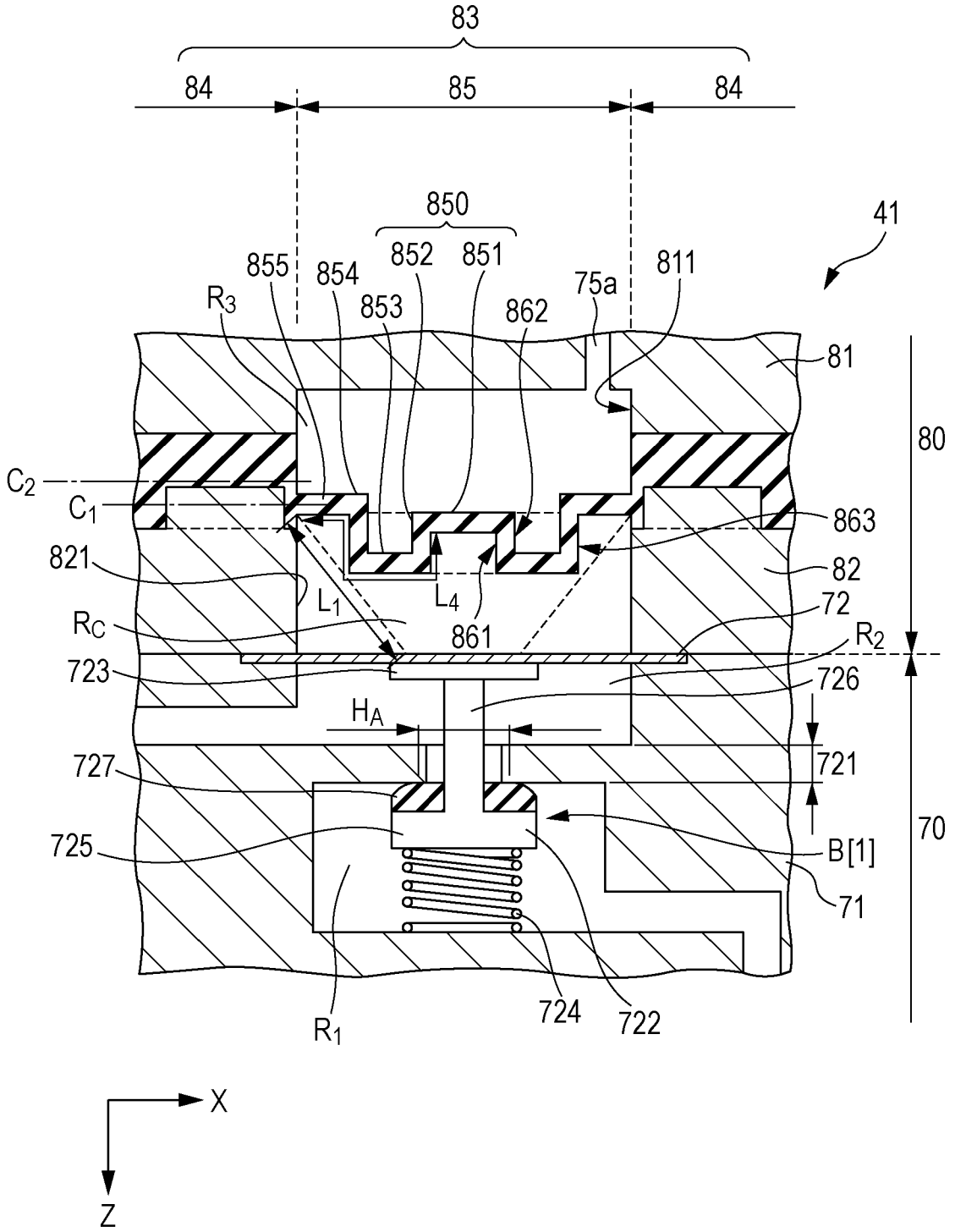
FIG. 16 is a sectional view of a main portion illustrating a modification example of the flow path unit according to the second embodiment.

As illustrated in FIG. 16, the contact portion 851 of the flexible membrane 83 is disposed at a position closer to the opening/closing valve B[1] than the second connection portion 855 is. Even in the configuration, when the total length $L_4$ of the first wall portion 852, the first connection portion 853, the second wall portion 854, and the second connection portion 855 is longer than the shortest distance $L_1$, the opening/closing valve B[1] can be reliably operated by the flexible membrane 83.

Third Embodiment

Figure 17:
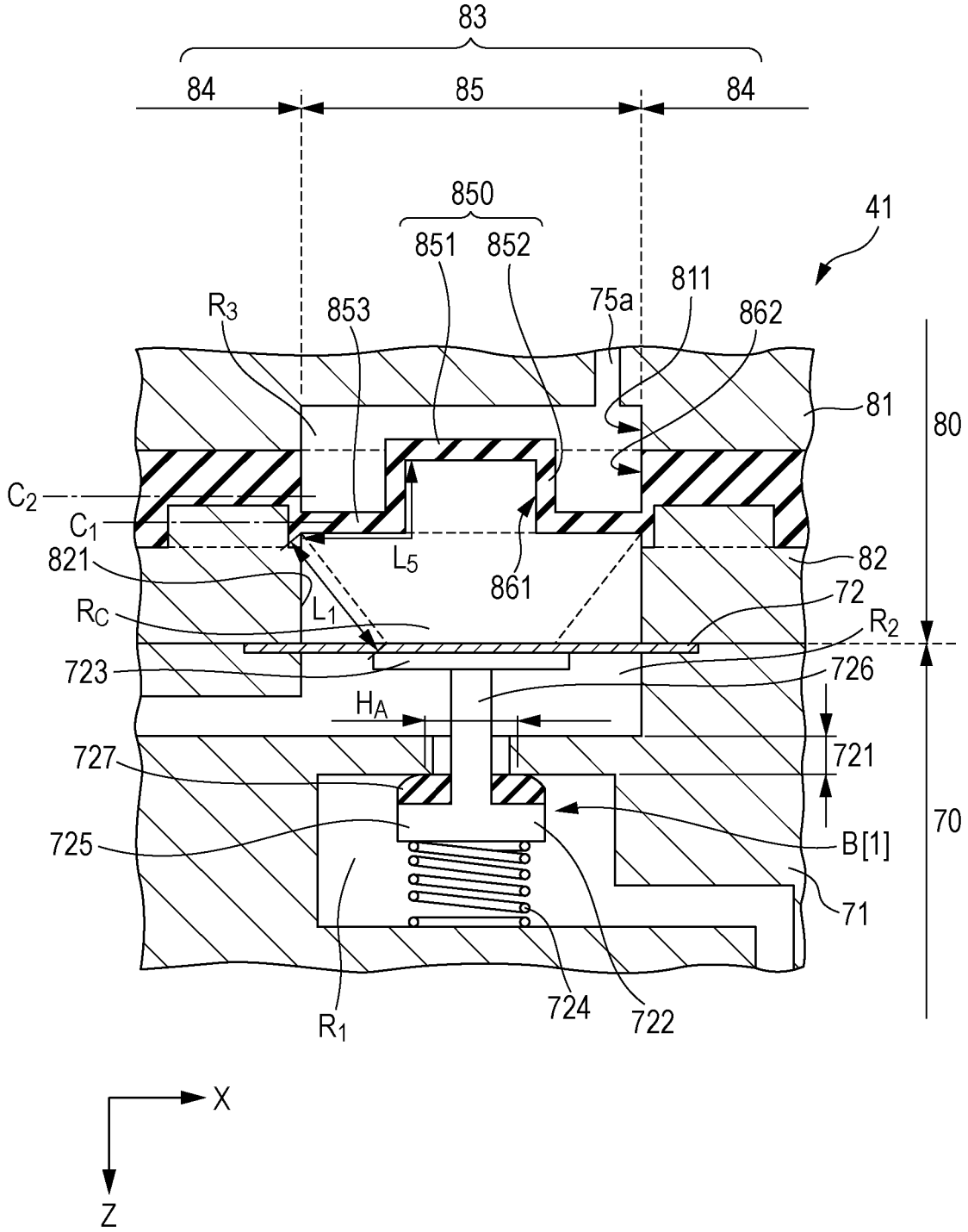
FIG. 17 is a sectional view of a main portion of the flow path unit according to a third embodiment.
Figure 18:
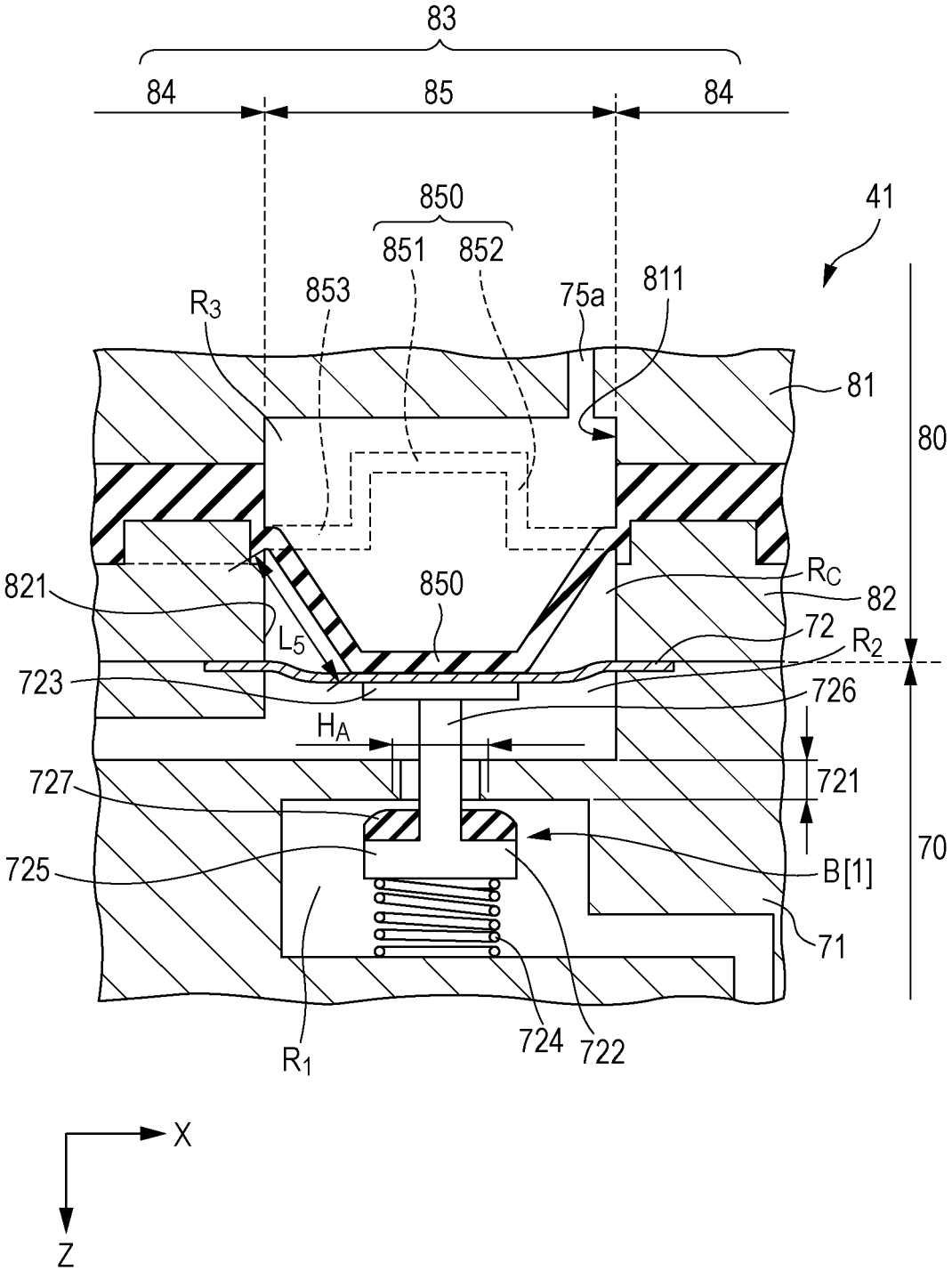
FIG. 18 is a sectional view of a main portion of the flow path unit according to the third embodiment.

FIGS. 17 and 18 are sectional views of a main portion of the flow path unit according to a third embodiment of the invention, FIG. 17 is a view illustrating a state in the depressurization operation, and FIG. 18 is a view illustrating a state in the pressurization operation. The same reference numerals are given to the same members as those of the embodiment described above, and a repeated description thereof will be omitted.

As illustrated in FIG. 17, the flexible membrane 83 according to the present embodiment includes the fixed portions 84 that are interposed and fixed between the lid member 81 and the spacer 82 in the Z direction, and the flexible portion 85 that partitions the space $R_3$ and the control chamber $R_C$.

In the depressurization operation, the flexible portion 85 includes a contact portion 851, a first wall portion 852, and a first connection portion 853. That is, the flexible portion 85 according to the present embodiment is not provided with the second wall portion 854 and the second connection portion 855. The contact portion 851, the first wall portion 852, and the first connection portion 853 that constitute the flexible portion 85 have substantially the same thickness, and the fixed portion 84 is thicker than the flexible portion 85. In addition, since the contact portion 851, the first wall portion 852, and the first connection portion 853 that constitute the flexible portion 85 are similar to those of the second embodiment described above, a repeated description thereof will be omitted.

In the flexible membrane 83, a bellows is formed around the contact portion 851 by the first wall portion 852 and the first connection portion 853, which have the same center and have an annular shape. That is, on the flexible portion 85 according to the present embodiment, a first recess portion 861 which is opened toward the film 72 is provided by the contact portion 851 and the first wall portion 852 provided around the contact portion 851. In addition, around the first recess portion 861, a second recess portion 862, which is opened toward the lid member 81 by the first wall portion 852, the first connection portion 853, and the fixed portion 84, is provided in a continuous annular shape in a circumferential direction thereof. The first recess portion 861 and the second recess portion 862 are provided at positions not overlapping with each other when viewed from the Z direction in plan view, and a bellows is formed by the recess portions. That is, in the present embodiment, the contact portion 851 and the first wall portion 852 of the flexible portion 85 form the protrusion portion 850, which becomes the projection toward the lid member 81 and becomes the recess toward the film 72 (the second recess portion 862).

In addition, in the present embodiment, opposing inner wall surfaces of the first recess portion 861 are disposed with a distance therebetween without being in contact with each other, the first recess portion 861 being recessed toward the film 72 by the protrusion portion 850. That is, the inner wall surfaces of the first wall portion 852 provided on both sides of the contact portion 851 in a direction including the X direction and the Y direction are disposed with a predetermined distance therebetween without being in contact with each other. In the present embodiment, similar to the first recess portion 861, opposing inner wall surfaces of the second recess portion 862 are disposed with a predetermined space therebetween without being in contact with each other.

Further, in the flexible membrane 83, a length $L_5$ from the root of the flexible portion 85 toward the fixed portion 84 to the contact position between the flexible portion 85 and the opening/closing valve B[1], in the present embodiment, the total length $L_5$ of the first wall portion 852 and the first connection portion 853, is longer than the shortest distance $L_1$ between the root of the flexible portion 85 of the flexible membrane 83 and the opening/closing valve B[1].

Figure 19:
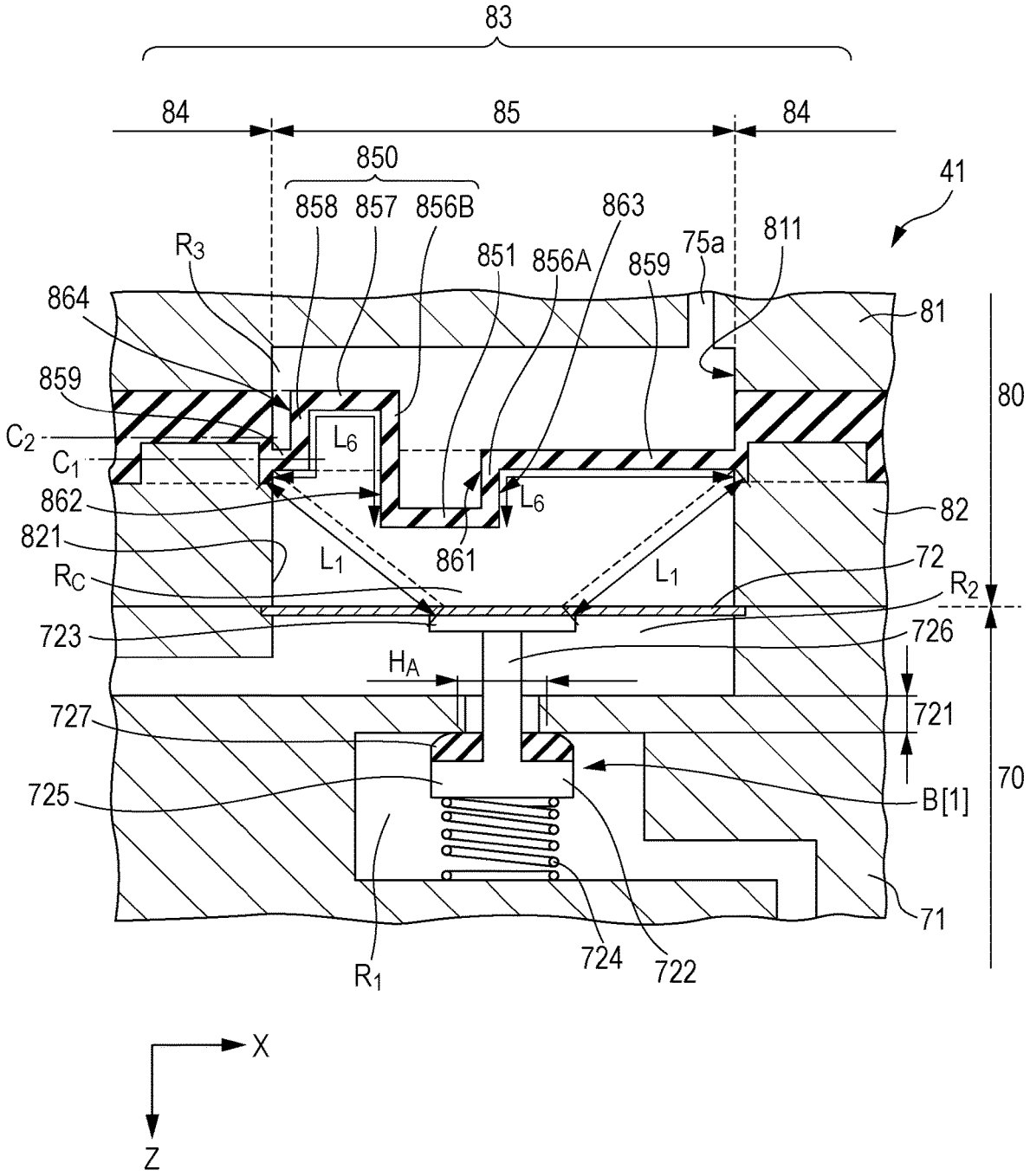
FIG. 19 is a sectional view of a main portion of the flow path unit according to a fourth embodiment.

When the flexible membrane 83 is pressurized by the pressurization operation of the pressure adjustment mechanism 18, as illustrated in FIG. 19, the flexible portion 85 of the flexible membrane 83 is elastically deformed such that the contact portion 851 moves toward the film 72. In other words, the flexible portion 85 is elastically deformed such that the first recess portion 861 formed by the contact portion 851 and the first wall portion 852 forming the bellows is expanded, and thus the contact portion 851 moves toward the opening/closing valve B[1]. That is, the first wall portion 852 extending from the first connection portion 853 in the negative Z direction is elastically deformed so as to be bent in the positive Z direction, and thus the contact portion 851 moves toward the opening/closing valve B[1]. The contact portion 851 that is moved toward the film 72 is brought into contact with the film 72, and presses the film 72 in the positive Z direction. Thus, the opening/closing valve B[1] is opened.

Even in the flexible membrane 83 with such a configuration, similar to the embodiments described above, the area by which the flexible membrane 83 receives the pressure from the degassing path 75 as a fluid flow path, is increased. Therefore, the flexible membrane 83 can be operated by a relatively low pressure.

In addition, the length $L_5$ from the root of the flexible portion 85 toward the fixed portion 84 to the contact position between the flexible portion 85 and the opening/closing valve B[1] of the valve mechanism 70 is longer than the shortest distance $L_1$, and thus, when the protrusion portion 850 of the flexible portion 85 of the flexible membrane 83 is deformed so as to be widened, the opening/closing valve B[1] can be reliably pressed and operated by the flexible portion 85.

In addition, in the present embodiment, the flexible membrane 83 is interposed and fixed between the lid member 81 and the spacer 82, and the opposing inner wall surfaces of the first recess portion 861 which is a recess of the flexible membrane 83 are disposed with a distance therebetween without being in contact with each other. Thus, a hindrance of the deformation of the flexible membrane 83 can be prevented.

In addition, the center $C_1$ of the end portion of the flexible portion 85 toward the fixed portion 84 is positioned at a position closer to the opening/closing valve B[1] than the center $C_2$ of the end portion of the fixed portion 84 toward the flexible portion 85 is. Thus, the fixed portion 84 is elongated by interposing and fixing the fixed portion 84. Therefore, the flexible portion 85 can be prevented from being deformed so as to protrude toward the lid member 81, and thus it is possible to prevent an increase in distance between the flexible portion 85 and the opening/closing valve B[1].

Fourth Embodiment

Figure 20:
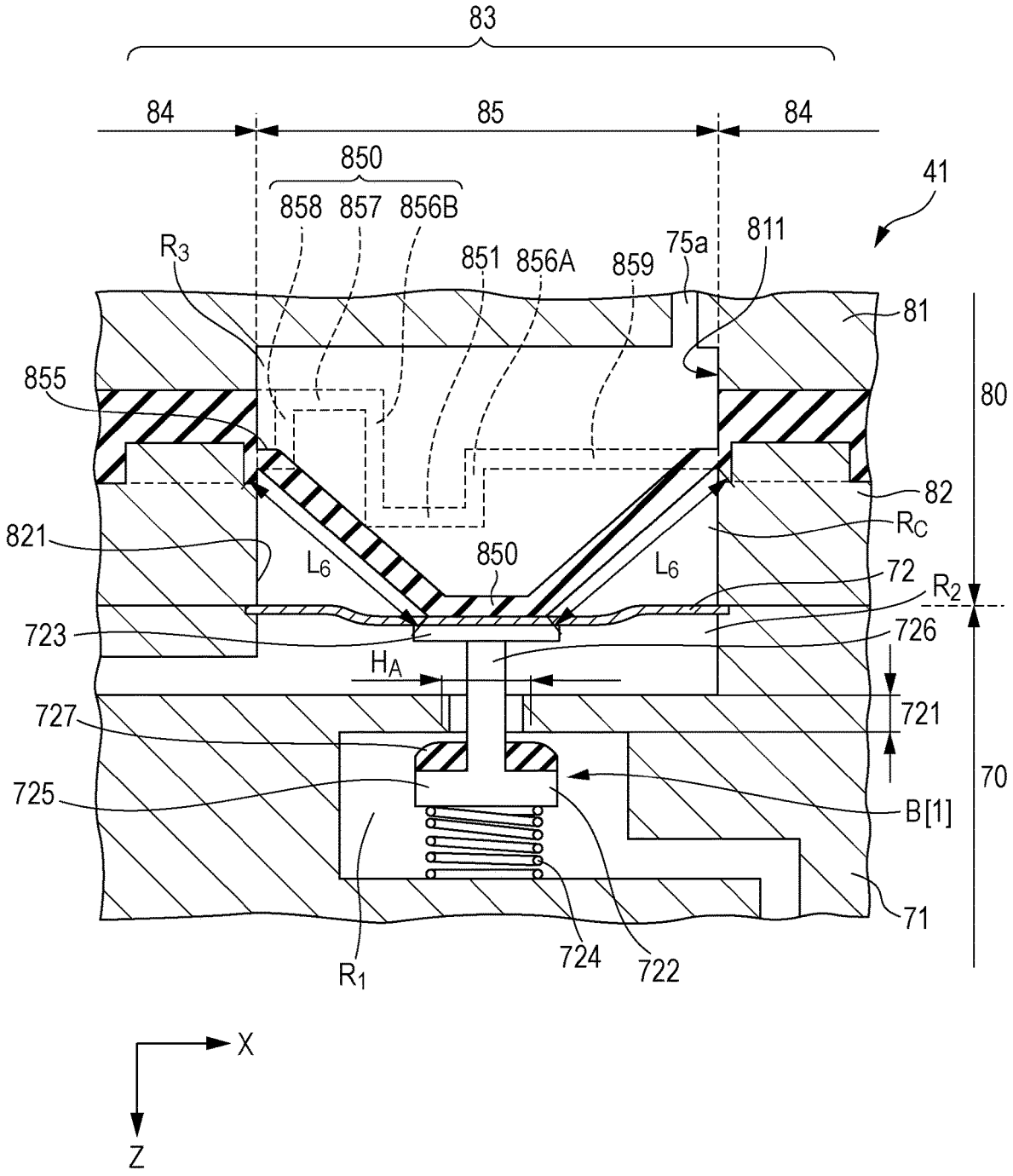
FIG. 20 is a sectional view of a main portion of the flow path unit according to the fourth embodiment.

FIGS. 19 and 20 are sectional views of a main portion of the flow path unit according to a fourth embodiment of the invention, FIG. 19 is a view illustrating a state in the depressurization operation, and FIG. 20 is a view illustrating a state in the pressurization operation. The same reference numerals are given to the same members as those of the embodiment described above, and a repeated description thereof will be omitted.

As illustrated in FIG. 19, the flexible membrane 83 according to the present embodiment includes the fixed portions 84 that are interposed and fixed between the lid member 81 and the spacer 82 in the Z direction, and the flexible portion 85 that partitions the space $R_3$ and the control chamber $R_C$.

In the depressurization operation, the flexible portion 85 includes a contact portion 851, a third wall portion 856A, a fourth wall portion 856B, a third connection portion 857, a fifth wall portion 858, and a fourth connection portion 859. The contact portion 851, the third wall portion 856A, the fourth wall portion 856B, the third connection portion 857, the fifth wall portion 858, and the fourth connection portion 859 that constitute the flexible portion 85 have substantially the same thickness, and the fixed portion 84 is thicker than the flexible portion 85.

The third wall portion 856A is erectly provided to be extended from the contact portion 851 toward the lid member 81 at a side of the contact portion 851 in the positive X direction.

The fourth wall portion 856B is erectly provided to be extended from the contact portion 851 toward the lid member 81 at a side of the contact portion 851 in the negative X direction. The fourth wall portion 856B is longer than the third wall portion 856A in the Z direction. An end portion of the third wall portion 856A and an end portion of the fourth wall portion 856B may be continuous or discontinuous in the Y direction.

One end of the third connection portion 857 is connected to the other end portion of the fourth wall portion 856B that is positioned toward the lid member 81, and the other end of the third connection portion 857 is extended from the fourth wall portion 856B in the negative X direction.

The fifth wall portion 858 is erectly provided to be closer to the film 72 than the third connection portion 857 is.

The fourth connection portion 859 is provided continuously so as to connect the end portion of the third wall portion 856A and the fixed portion 84 and to connect the end portion of the fifth wall portion 858 and the fixed portion 84, around the third wall portion 856A, the fourth wall portion 856B, the third connection portion 857, and the fifth wall portion 858.

In this manner, a bellows is formed on the flexible membrane 83 by the third wall portion 856A, the fourth wall portion 856B, the third connection portion 857, and the fifth wall portion 858. That is, the first recess portion 861 which is opened toward the lid member 81 is provided on the flexible portion 85 according to the present embodiment by the contact portion 851, the third wall portion 856A, and the fourth wall portion 856B. In addition, the second recess portion 862 is provided on the flexible portion 85 by the fourth wall portion 856B, the third connection portion 857, and the fifth wall portion 858, at a side of the first recess portion 861 in the negative X direction. Further, the third recess portion 863 which is opened toward the film 72 by the third wall portion 856A, the fourth connection portion 859, and the fixed portion 84, is provided on the flexible portion 85. In addition, the fourth recess portion 864 which is opened toward the lid member 81 by the fifth wall portion 858, the fourth connection portion 859, and the fixed portion 84, is provided on the flexible portion 85. The first recess portion 861, the second recess portion 862, the third recess portion 863, and the fourth recess portion 864 are provided at positions not overlapping with each other when viewed from the Z direction in plan view, and a bellows is formed by the recess portions. That is, in the present embodiment, the fourth wall portion 856B, the third connection portion 857, and the fifth wall portion 858 of the flexible portion 85 form the protrusion portion 850, which becomes a projection toward the lid member 81 and becomes a recess toward the film 72 (the second recess portion 862).

In addition, in the present embodiment, opposing inner wall surfaces of the second recess portion 862 are disposed with a distance therebetween without being in contact with each other, the second recess portion 862 being recessed toward the film 72 by the protrusion portion 850. That is, the fourth wall portion 856B and the fifth wall portion 858 forming the second recess portion 862 are disposed with a predetermined distance therebetween without being in contact with each other. In the present embodiment, similar to the second recess portion 862, opposing inner wall surfaces of each of the first recess portion 861, the third recess portion 863, and the fourth recess portion 864 are disposed with a predetermined distance therebetween without being in contact with each other.

Further, in the flexible membrane 83, a length $L_6$ from the root of the flexible portion 85 toward the fixed portion 84 to a contact position between the flexible portion 85 and the opening/closing valve B[1], is longer than the shortest distance $L_1$ between the root of the flexible portion 85 of the flexible membrane 83 and the opening/closing valve B[1]. In the present embodiment, the flexible portion 85 is provided such that the length $L_6$ in the negative X direction from the contact portion 851 to the fixed portion 84 is the same as the length $L_6$ in the positive X direction from the contact portion 851 to the fixed portion 84. Therefore, when the flexible portion 85 is deformed, the contact portion 851 can be moved on the center in the X direction.

When the flexible membrane 83 is pressurized by the pressurization operation of the pressure adjustment mechanism 18, as illustrated in FIG. 20, the flexible portion 85 of the flexible membrane 83 is elastically deformed such that the contact portion 851 moves toward the film 72. In other words, the flexible portion 85 is elastically deformed such that the second recess portion 862 formed by the fourth wall portion 856B, the third connection portion 857, and the fifth wall portion 858 forming the bellows is expanded, and thus the contact portion 851 moves toward the opening/closing valve B[1]. That is, the fifth wall portion 858 extending from the fourth connection portion 859 in the negative Z direction is elastically deformed so as to be bent in the positive Z direction, and thus the contact portion 851 moves toward the opening/closing valve B[1]. The contact portion 851 that is moved toward the film 72 is brought into contact with the film 72, and presses the film 72 in the positive Z direction. Thus, the opening/closing valve B[1] is opened.

Even in the flexible membrane 83 with such a configuration, similar to the embodiments described above, the area by which the flexible membrane 83 receives the pressure from the degassing path 75 as a fluid flow path, is increased. Therefore, the flexible membrane 83 can be operated by a relatively low pressure.

In addition, the length $L_6$ from the root of the flexible portion 85 toward the fixed portion 84 to the contact position between the flexible portion 85 and the opening/closing valve B[1] of the valve mechanism 70 is longer than the shortest distance $L_1$, and thus, when the protrusion portion 850 of the flexible portion 85 of the flexible membrane 83 is deformed so as to be widened, the opening/closing valve B[1] can be reliably pressed and operated by the flexible portion 85.

In addition, in the present embodiment, the flexible membrane 83 is interposed and fixed between the lid member 81 and the spacer 82, and the opposing inner wall surfaces of the first recess portion 861 which is a recess of the flexible membrane 83 are disposed with a distance therebetween without being in contact with each other. Thus, a hindrance of the deformation of the flexible membrane 83 can be prevented.

In addition, the center $C_1$ of the end portion of the flexible portion 85 toward the fixed portion 84 is positioned at a position closer to the opening/closing valve B[1] than the center $C_2$ of the end portion of the fixed portion 84 toward the flexible portion 85 is. Thus, the fixed portion 84 is elongated by interposing and fixing the fixed portion 84. Therefore, the flexible portion 85 can be prevented from being deformed so as to protrude toward the lid member 81, and thus it is possible to prevent an increase in distance between the flexible portion 85 and the opening/closing valve B[1].

Fifth Embodiment

Figure 21:
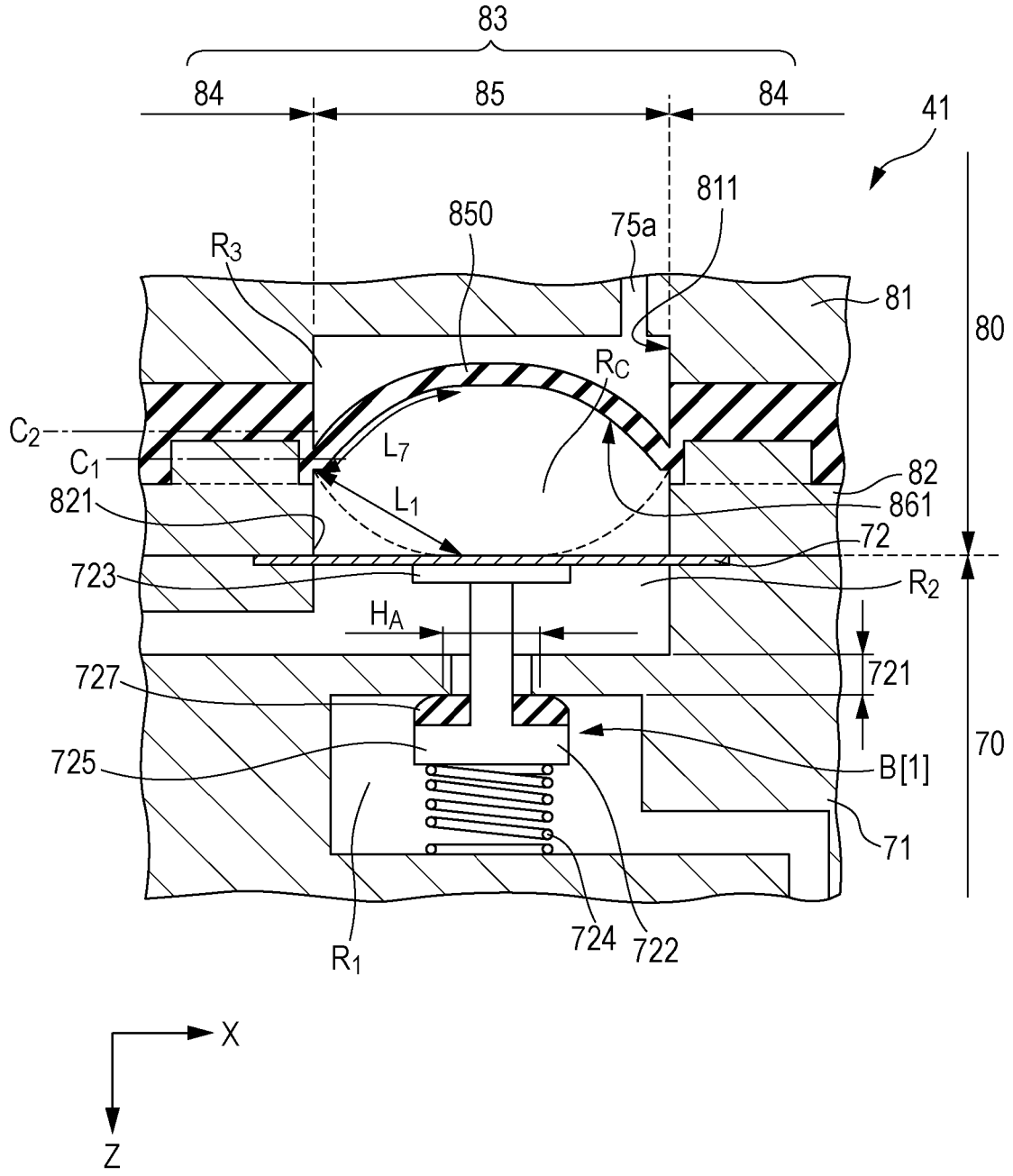
FIG. 21 is a sectional view of a main portion of the flow path unit according to a fifth embodiment.
Figure 22:
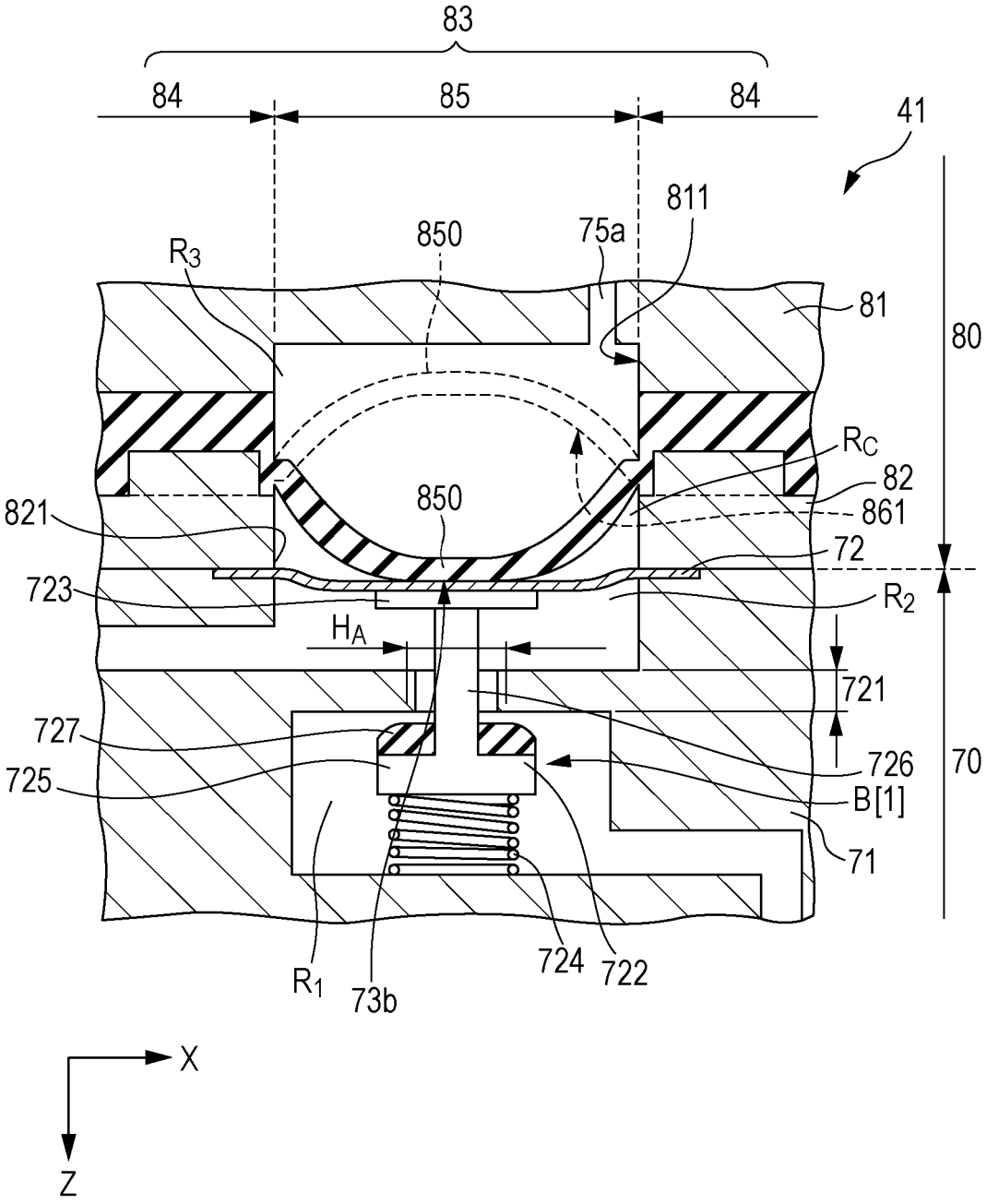
FIG. 22 is a sectional view of a main portion of the flow path unit according to the fifth embodiment.

FIGS. 21 and 22 are sectional views of a main portion of the flow path unit according to a fifth embodiment of the invention, FIG. 21 is a view illustrating a state in the depressurization operation, and FIG. 22 is a view illustrating a state in the pressurization operation. The same reference numerals are given to the same members as those of the embodiment described above, and a repeated description thereof will be omitted.

As illustrated in FIG. 21, the flexible membrane 83 according to the present embodiment includes the fixed portions 84 that are interposed and fixed between the lid member 81 and the spacer 82 in the Z direction, and the flexible portion 85 that partitions the space $R_3$ and the control chamber $R_C$.

In the depressurization operation, the flexible portion 85 is provided in a curved shape so as to protrude toward the control chamber $R_C$. That is, the first recess portion 861 which is opened toward the film 72 is provided on the flexible membrane 83, the entire flexible portion 85 is the protrusion portion 850 that becomes a projection toward the lid member 81 and becomes a recess toward the opening/closing valve B[1] by provision of the first recess portion 861.

In addition, in the present embodiment, opposing inner wall surfaces of the first recess portion 861 of the flexible portion 85 are disposed with a distance therebetween without being in contact with each other, the first recess portion 861 being recessed toward the film 72.

In addition, in the flexible membrane 83, a length $L_7$ from the root of the flexible portion 85 toward the fixed portion 84 to a contact position between the flexible portion 85 and the opening/closing valve B[1], is longer than the shortest distance $L_1$ between the root of the flexible portion 85 of the flexible membrane 83 and the opening/closing valve B[1].

In addition, in the flexible membrane 83, in the Z direction in which the fixed portion 84 is interposed, the center $C_1$ of the end portion of the flexible portion 85 toward the fixed portion 84 is provided at a position closer to the opening/closing valve B[1] than the center $C_2$ of the end portion of the fixed portion 84 toward the flexible portion 85 is.

When the flexible membrane 83 is pressurized by the pressurization operation of the pressure adjustment mechanism 18, as illustrated in FIG. 22, the flexible portion 85 of the flexible membrane 83 is elastically deformed such that one surface of the flexible portion 85 toward the lid member 81 becomes a recess and the other surface of the flexible portion 85 toward the film 72 becomes a projection. The flexible portion 85 moves toward the film 72, and thus the flexible portion 85 presses the film 72 in the positive Z direction. Thereby, the opening/closing valve B[1] is opened.

Even in the flexible membrane 83 with such a configuration, similar to the embodiments described above, the area by which the flexible membrane 83 receives the pressure from the degassing path 75 as a fluid flow path, is increased. Therefore, the flexible membrane 83 can be operated by a relatively low pressure.

In addition, the length $L_7$ from the root of the flexible portion 85 toward the fixed portion 84 to the contact position between the flexible portion 85 and the opening/closing valve B[1] of the valve mechanism 70 is longer than the shortest distance $L_1$, and thus, when the protrusion portion 850 of the flexible portion 85 of the flexible membrane 83 is deformed so as to be widened, the opening/closing valve B[1] can be reliably pressed and operated by the flexible portion 85.

In addition, in the present embodiment, the flexible membrane 83 is interposed and fixed between the lid member 81 and the spacer 82, and the opposing inner wall surfaces of the first recess portion 861 which is a recess of the flexible membrane 83 are disposed with a distance therebetween without being in contact with each other. Thus, a hindrance of the deformation of the flexible membrane 83 can be prevented.

In addition, the center $C_1$ of the end portion of the flexible portion 85 toward the fixed portion 84 is positioned at a position closer to the opening/closing valve B[1] than the center $C_2$ of the end portion of the fixed portion 84 toward the flexible portion 85 is. Thus, the fixed portion 84 is elongated by interposing and fixing the fixed portion 84. Therefore, the flexible portion 85 can be prevented from being deformed so as to protrude toward the lid member 81, and thus it is possible to prevent an increase in distance between the flexible portion 85 and the opening/closing valve B[1].

Other Embodiments

Although the embodiments according to the invention are described above, the basic configuration of the invention is not limited thereto.

For example, in each embodiment described above, although the space $R_3$ communicates with the pressure adjustment mechanism 18 via the degassing path 75, the space $R_3$ may not communicate with the pressure adjustment mechanism 18 via the degassing path 75 in a case where the pressure in the space $R_3$ can be adjusted. For example, in a state where the space $R_3$ does not communicate with the degassing path 75, the pressure in the space $R_3$ may be adjusted by a mechanism different from the pressure adjustment mechanism 18 via a fluid flow path other than the degassing path 75.

In addition, in each embodiment described above, although the space $R_3$ is formed by covering the recess portion 811 of the lid member 81 with the flexible membrane 83, the recess portion 811 may not be provided in the lid member 81. For example, the space $R_3$ may be formed by providing a recess portion on the flexible membrane 83 and covering the recess portion with the lid member 81.

In each embodiment described above, although the thickness of the flexible portion 85 is set to be substantially the same, the invention is not particularly limited thereto. The contact portion 851 of the flexible portion 85 that is brought into contact with the opening/closing valve B[1] may be thicker than other portions. In addition, a projection portion protruding toward the opening/closing valve B[l] may be provided on a part of the contact portion 851 that is brought into contact with the opening/closing valve B[1].

In addition, in each embodiment described above, although the first wall portion 852, the second wall portion 854, the third wall portion 856A, the fourth wall portion 856B, and the fifth wall portion 858 are provided along the Z direction, the invention is not particularly limited thereto. The portions may be provided along a direction inclined with respect to the Z direction. In addition, although the first connection portion 853, the second connection portion 855, the third connection portion 857, and the fourth connection portion 859 are provided along a plane direction including the X direction and the Y direction, the invention is not particularly limited thereto. The portions may be provided along a direction inclined with respect to either one or both of the X direction and the Y direction.

Figure 23:
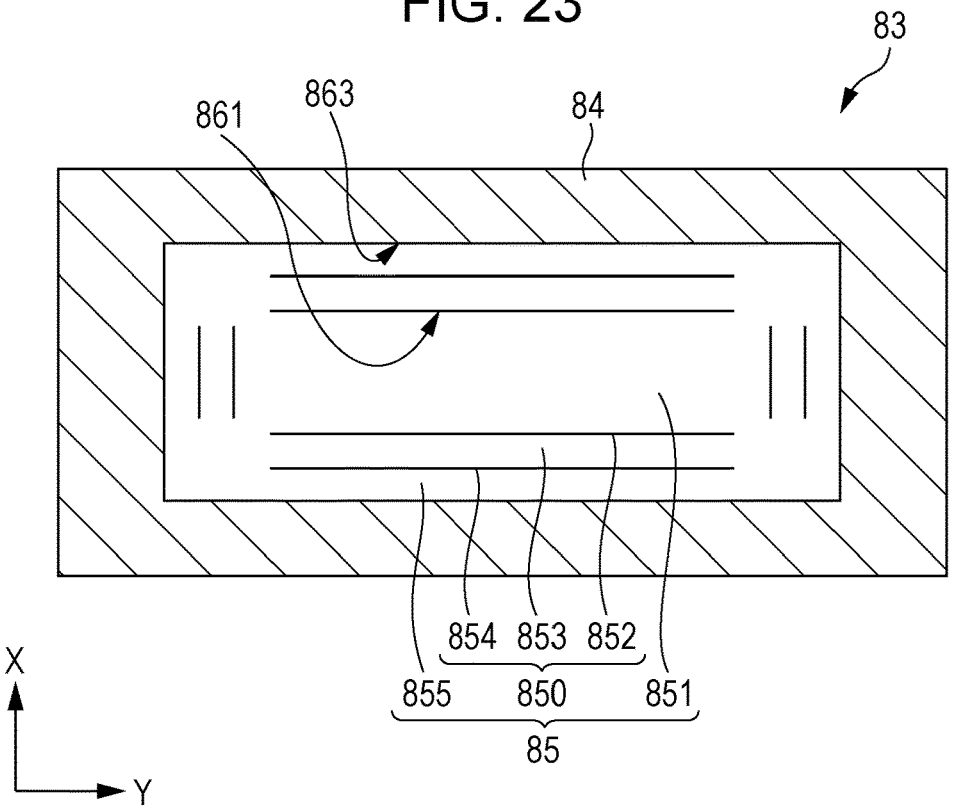
FIG. 23 is a plan view illustrating a modification example of the flexible membrane.
Figure 24:
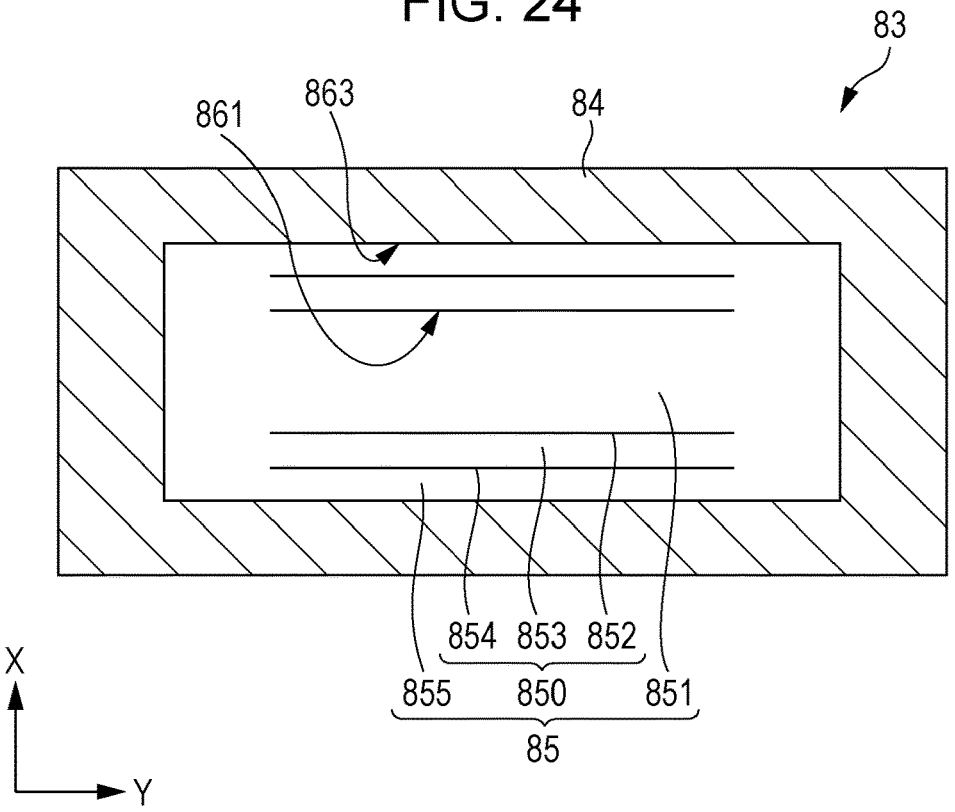
FIG. 24 is a plan view illustrating a modification example of the flexible membrane.

In the first to fifth embodiments described above, although the bellows is provided continuously around the contact portion 851, the invention is not particularly limited thereto. The bellows may be provided discontinuously. In FIGS. 23 and 24, examples of the bellows are illustrated. FIGS. 23 and 24 are plan views illustrating modification examples of the flexible membrane according to the first embodiment.

As illustrated in FIG. 23, each of the first wall portion 852, the first connection portion 853, and the second wall portion 854 may be provided around the contact portion 851 so as to be discontinuous in a circumferential direction thereof.

In addition, as illustrated in FIG. 24, the first wall portion 852, the first connection portion 853, and the second wall portion 854 may be provided at both sides of the contact portion 851 in the X direction, and may not be provided at both sides of the contact portion 851 in the Y direction.

In addition, although the opening/closing valve B[1] according to each of the above-described embodiments is configured to be closed by energizing the valve body 722 by the energization of the spring 724, the invention is not particularly limited thereto, and the opening/closing valve B[1] may be configured to be closed by its own weight.

In each of the above-described embodiments, although the configuration in which the flow path provided with the opening/closing valve B[1] communicates with the space $R_2$ is exemplified, the invention is not particularly limited thereto. For example, a configuration in which, the flow path provided with the opening/closing valve B[1] communicates with the power source for pressure-feeding the liquid to the storage chamber, that is, the liquid pressure feed mechanism 16 without communicating with the space $R_2$ as the storage chamber, in which the liquid pressure feed mechanism 16 operates to pressure-feed the ink to the space $R_2$ as the storage chamber by opening the opening/closing valve B[1], and as a result, in which the first pressure on one side of the film 72 is increased may be used. In other words, the flow path that is opened and closed by the opening/closing valve B[1] may be a flow path for fluids other than ink, and the ink may flow by opening and closing of the opening/closing valve B[1].

The film 72 as the pressure receiving portion may be any movable element as long as the film 72 can be moved according to the balance between the first pressure and the second pressure, and the material of the film 72 may be, for example, a membrane, a metal thin plate, or the like. The shape of the film 72 may be a flat shape, may be a so-called bellows shape in which bending is repeated, or may be a bag-shaped body.

In each embodiment, although the film 72 partitions the space $R_2$ and the control chamber $R_C$, the invention is not particularly limited thereto, and the film 72 may be provided as a bag-shaped body inside the storage chamber.

Although the flexible membrane 83 is made of an elastic member such as rubber, the invention is not particularly limited thereto, and the flexible membrane 83 may be made of a flexible resin or a flexible metal.

In each embodiment described above, although the bubbles in the degassing space Q are removed by depressurizing the degassing space Q, the purpose for depressurizing is not particularly limited thereto. For example, the depressurized space may be used to collect the ink in the flow path together with the air bubble, by communicating with the flow path through which the ink passes via a one-way valve and opening the one-way valve at the time of depressurizing the space. In other words, the depressurized space may be used for the purpose of collecting the air bubble included in the ink. The depressurized space may also be used for another use other than the purpose of collecting the air bubble included in the ink. As another use, for example, by changing the volume of the damper chamber for absorbing the pressure change in the flow path due to the pressurization of the space, the characteristics of the damper chamber may be changed. Furthermore, the space may be used to remove the dust attached to the vicinity of the nozzles N by suction, by opening the space so as to face the nozzles N and depressurizing the space.

In a case where depressurization is used in order to remove the air bubble in the degassing space Q, at least a portion of the depressurized space is preferably formed by a sheet-shaped gas-permeable member (for example, a thin film of polyacetal, polypropylene, polyphenylene ether, or the like), or a rigid wall having a thickness enough to exhibit gas permeability (for example, a rigid wall obtained by forming the degassing flow path unit 42 including gas-permeable partitions with a plastic material such as POM (polyacetal), m-PPE (modified polyphenylene ether), or PP (polypropylene), or alloys of these materials, and typically making the thickness of the rigid wall to approximately 0.5 mm). Alternatively, in a case where the chamber that communicates with the chamber formed by the sheet-shaped member or the rigid wall via a valve corresponds to the depressurization space, the depressurization space may be formed by a thermosetting resin, metal, or the like. In a case where the space is used in order to remove the dust attached to the vicinity of the nozzles N by suction using the depressurization to the space, the space is preferably formed by a thermosetting resin, metal, or the like.

In each of the above-described embodiments, although air as the fluid from the pressure adjustment mechanism 18 as the fluid supply source is illustrated, the fluid is not particularly limited thereto. As the fluid, inert gas, liquid used for ink, liquid other than ink, or the like may be used.

In each of the above-described embodiments, although the piezoelectric actuator 484 is used as a pressure generating unit that causes a pressure change in the pressure chamber $S_C$, as the piezoelectric actuator 484, for example, a thin film type piezoelectric element in which electrodes and a piezoelectric material are stacked and formed by film formation and lithography, a thick film type piezoelectric element formed by a method such as attaching of a green sheet, or a longitudinal vibration type piezoelectric element in which a piezoelectric material and an electrode forming material are alternately laminated and the laminated layers are extended in the axial direction may be used. As a pressure generating unit, an element in which a heating element is disposed in the pressure chamber $S_C$ and a droplet is discharged from the nozzle by bubbles generated by heat generation of the heating element, or an element in which static electricity is generated between the vibration plate and the electrode and a droplet is discharged from the nozzle by deforming the vibration plate by the electrostatic force may be used.

In the embodiments described above, although the configuration in which the liquid ejecting unit 40 includes the flow path unit 41 as the flow path structure is illustrated, the invention is not particularly limited thereto, and the liquid ejecting unit 40 may be provided with the flow path unit 41 as the flow path structure. That is, the flow path unit 41 and the place where the liquid ejecting unit 44 may be provided at different places from each other.

Figure 25:
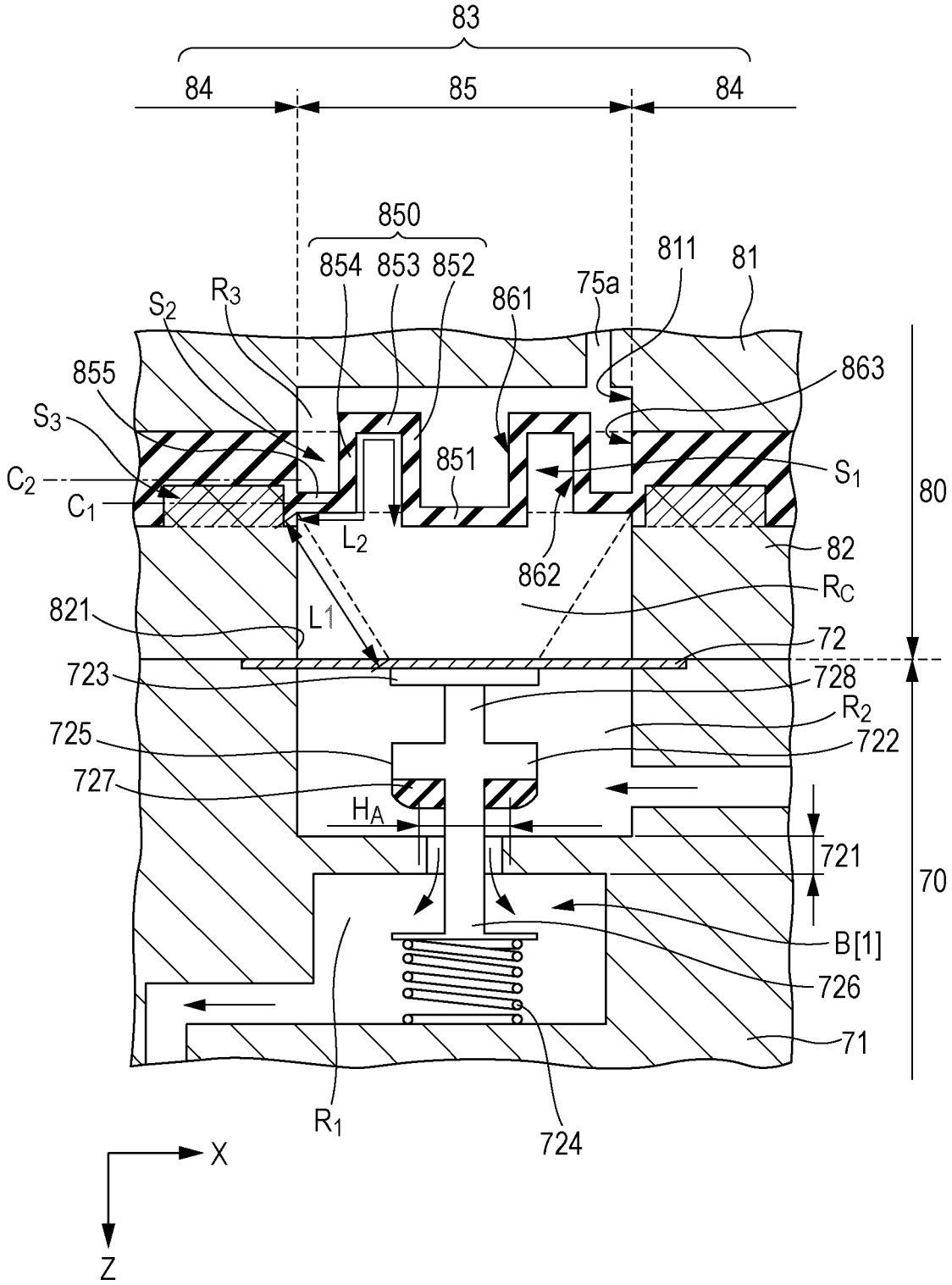
FIG. 25 is a sectional view of a main portion illustrating a modification example of the flow path unit.
Figure 26:
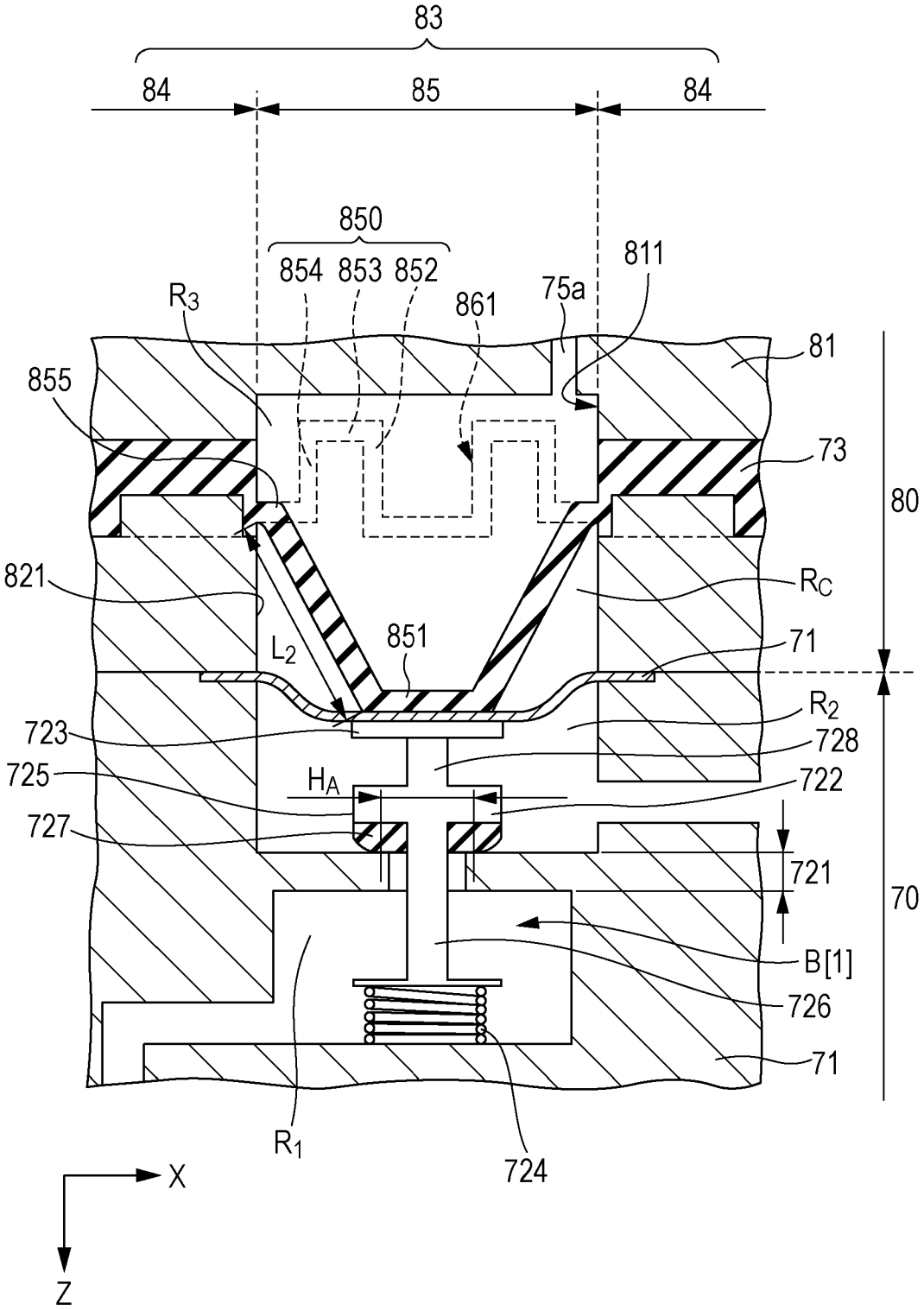
FIG. 26 is a sectional view of a main portion illustrating a modification example of the flow path unit.

Further, in each embodiment described above, although the flexible membrane mechanism presses the opening/closing valve B[1] of the valve mechanism and thus the opening/closing valve B[1] is opened, the invention is not particularly limited thereto. In FIGS. 25 and 26, modification examples of the flow path unit are illustrated. FIGS. 25 and 26 are sectional views of a main portion of the flow path unit, FIG. 25 is a view illustrating a state in the depressurization operation, and FIG. 26 is a view illustrating a state in the pressurization operation.

As illustrated in FIG. 25, the flow path unit 41 includes a valve mechanism 70 and a flexible membrane mechanism 80. The valve mechanism 70 includes a valve mechanism housing 71, an opening/closing valve B[1], and a film 72. In the valve mechanism housing 71, a space $R_1$ and a space $R_2$ are formed. The space $R_1$ is connected to a flow path on the downstream side, for example, a flow path of the degassing flow path unit 42 or the liquid ejecting portion 44, and the ink is supplied from the space $R_2$ to the degassing flow path unit 42 or the liquid ejecting portion 44. The space $R_2$ is connected to a flow path on the upstream side, for example, the liquid container 14, and the ink is supplied from the liquid container 14.

The opening/closing valve B[1] includes a valve seat 721, a valve body 722, a pressure receiving plate 723, and a spring 724. The valve seat 721 is a part of the valve mechanism housing 71, and is a flat plate-shaped portion that partitions the space $R_1$ and the space $R_2$. In the valve seat 721, a communication hole $H_A$ that allows the space $R_1$ to communicate with the space $R_2$ is formed. The pressure receiving plate 723 is a substantially circular-shaped flat plate member which is provided on a surface of the film 72 that faces the valve seat 721.

The valve body 722 includes a base portion 725, a first valve shaft 726, a sealing portion 727, and a second valve shaft 728. The base portion 725 is disposed in the space $R_2$. In addition, the first valve shaft 726 is provided so as to protrude vertically from a front surface of the base portion 725 toward the positive Z direction. Further, the second valve shaft 728 is provided so as to protrude vertically from the front surface of the base portion 725 toward the pressure receiving plate 723. In the valve body 722, the first valve shaft 726 is inserted into a communication hole $H_A$, and is energized toward the pressure receiving plate 723 by the spring 724.

The flexible membrane mechanism 80 similar to that of the first embodiment is provided on the valve mechanism 70 in the negative Z direction.

As illustrated in FIG. 26, when the flexible membrane 83 is deformed by the pressurization operation and thus the flexible membrane 83 presses the film 72 and the pressure receiving plate 723 in the positive Z direction, the sealing portion 727 of the valve body 722 is brought into contact with the valve seat 721. Thus, the space $R_1$ and the space $R_2$ are separated (blocked) from each other. As illustrated in FIG. 25, when the deformation of the flexible membrane 83 is released by the depressurization operation, the valve body 722 moves toward the film 72 by the energization of the spring 724, and thus the space $R_1$ and the space $R_2$ communicate with each other via the communication hole $H_A$, that is, are opened. Therefore, the ink supplied to the space $R_2$ is supplied to the downstream side from the space $R_1$. The valve mechanism 70 and the flexible membrane mechanism 80 can be used, for example, for a so-called choke cleaning in which the ink with bubbles is sucked from the nozzle N in a state where the flow path is choked and the choke of the flow path is released at once.

The invention can be broadly applied to a liquid ejecting apparatus in general, and for example, be applied to a recording head such as various ink jet recording heads used in an image recording apparatus such as a printer, a color material ejecting head used for manufacturing a color filter such as a liquid crystal display, an organic EL display, an electrode material ejecting head used for forming an electrode such as an FED (field emission display), and a liquid ejecting apparatus using a bioorganic material ejecting head used for manufacturing a biochip.

In addition, in the first embodiment described above, although the flexible membrane mechanism 80 is provided in the liquid ejecting head, the invention is not particularly limited thereto. The flexible membrane mechanism 80 may be provided in a liquid ejecting apparatus other than the liquid ejecting head.

The invention can be broadly applied to a flow path member in general, and can be used for devices other than a liquid ejecting apparatus or a liquid ejecting head.

The entire disclosure of Japanese Patent Application No. 2017-53604, filed Mar. 17, 2017 is expressly incorporated by reference herein.

What is claimed is:

1. A flexible membrane mechanism that is used in a valve mechanism, the flexible membrane mechanism comprising:

a lid member;

a flexible membrane that forms a space between the lid member and the flexible membrane;

a fluid flow path that communicates with the space; and a controller configured to deform the flexible membrane such that a valve of the valve mechanism is opened and closed, and wherein the controller deforms the flexible membrane such that the flexible membrane takes (i) a first form in which the flexible membrane has a first convex portion being convex away from the lid member, and (ii) a second form in which the flexible member has a second convex portion and third convex portion, the second convex portion being convex away from the valve mechanism, and the third convex portion being convex away from the valve mechanism and being different from the second convex portion.

2. The flexible membrane mechanism according to claim 1, wherein the flexible membrane includes a fixed portion that is fixed outside the space and a flexible portion that is extended from the fixed portion into the space, and wherein a length of the flexible portion from a root of the flexible portion toward the fixed portion to a contact position between the flexible portion and the valve mechanism is longer than the shortest distance between the root of the flexible portion of the flexible membrane and the valve.

3. A flow path member comprising:

the flexible membrane mechanism according to claim 2; and a valve mechanism.

4. A liquid ejecting apparatus comprising:

the flexible membrane mechanism according to claim 2; and a liquid ejecting head that ejects a liquid.

5. The flexible membrane mechanism according to claim 1, wherein the flexible membrane is interposed and fixed between the lid member and a member provided on the lid member toward the flexible membrane, and wherein opposing inner wall surfaces of the recess of the flexible membrane are disposed with a distance therebetween without being in contact with each other.

6. A flow path member comprising:

the flexible membrane mechanism according to claim 5; and a valve mechanism.

7. A liquid ejecting apparatus comprising:

the flexible membrane mechanism according to claim 5; and a liquid ejecting head that ejects a liquid.

8. The flexible membrane mechanism according to claim 1, wherein the flexible membrane includes a fixed portion that is disposed outside the space and is interposed and fixed between the lid member and a member provided on the lid member toward the flexible membrane, and a flexible portion that is extended from the fixed portion into the space, and wherein, in a direction in which the fixed portion of the flexible membrane is interposed, the center of an end portion of the flexible portion toward the fixed portion is positioned at a position closer to the valve than the center of an end portion of the fixed portion toward the flexible portion is.

9. A flow path member comprising:

the flexible membrane mechanism according to claim 8; and a valve mechanism.

10. A liquid ejecting apparatus comprising:

the flexible membrane mechanism according to claim 8; and a liquid ejecting head that ejects a liquid.

11. The flexible membrane mechanism according to claim 1, wherein the valve mechanism includes a chamber which communicates with the valve and a film which defines at least a part of the chamber and is deformed such that the valve is opened or closed by deformation of the film, and wherein the flexible membrane mechanism further includes a spacer for maintaining a constant distance between the film and the flexible membrane.

12. A flow path member comprising:

the flexible membrane mechanism according to claim 11; and a valve mechanism.

13. A liquid ejecting apparatus comprising:

the flexible membrane mechanism according to claim 11; and a liquid ejecting head that ejects a liquid.

14. A flow path member comprising:

the flexible membrane mechanism according to claim 1; and a valve mechanism.

15. A liquid ejecting apparatus comprising:

the flexible membrane mechanism according to claim 1; and a liquid ejecting head that ejects a liquid.

16. The flexible membrane mechanism according to claim 1, further comprising:

a pressing mechanism that increases and reduces pressure of fluid flow in the space, wherein the flexible membrane takes the first form in a case where the pressing mechanism performs reducing pressure, and takes the second form in a case where the pressing mechanism performs increasing pressure.

17. The flexible membrane mechanism according to claim 1, wherein a center of the first convex portion in the first form is positioned at intermediate between the second convex portion in the second form and the third convex portion in the second form.

18. A flexible membrane mechanism that is used in a valve mechanism, the flexible membrane mechanism comprising:

a lid member;

a flexible membrane that forms a space between the lid member and the flexible membrane; and a fluid flow path that communicates with the space, wherein the flexible membrane is deformed such that a valve of the valve mechanism is opened and closed, and wherein the flexible membrane takes (i) a first form in which the flexible membrane is bent toward the lid member and is not in contact with the valve mechanism, and (ii) a second form in which the flexible member is bent toward the valve mechanism to contact the valve mechanism.

* * * * *